US005190850A

United States Patent [19]

Sakai et al.

[11] Patent Number: 5,190,850

[45] Date of Patent: Mar. 2, 1993

[54] SILVER HALIDE PHOTOGRAPHIC MATERIAL

[75] Inventors: Minoru Sakai; Kazunobu Katoh, both of Kanagawa, Japan

[73] Assignee: Fuji Photo Film Co., Ltd., Kanagawa, Japan

[21] Appl. No.: 699,835

[22] Filed: May 14, 1991

[30] Foreign Application Priority Data

May 14, 1990 [JP] Japan ..... 2-123683

[51] Int. Cl.[5] ..... G03C 1/46

[52] U.S. Cl. ..... 430/503; 430/264; 430/509; 430/506; 430/957; 430/223

[58] Field of Search ..... 430/264, 509, 506, 957, 430/223, 503

[56] References Cited

U.S. PATENT DOCUMENTS

| | | | |
|---|---|---|---|
| 4,684,604 | 8/1987 | Harder | 430/223 |
| 4,948,716 | 8/1990 | Mihayashi et al. | 430/506 |
| 5,006,445 | 4/1991 | Yagihara et al. | 430/264 |
| 5,085,971 | 2/1992 | Katoh et al. | 430/264 |
| 5,134,055 | 7/1992 | Okamura et al. | 430/264 |
| 5,145,765 | 9/1992 | Okamura et al. | 430/264 |

FOREIGN PATENT DOCUMENTS

| | | |
|---|---|---|
| 0304433 | 12/1990 | Japan . |
| 0067241 | 3/1991 | Japan . |
| 0067244 | 3/1991 | Japan . |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material having on a support a first light-sensitive layer containing a light-sensitive silver halide emulsion and a second light-sensitive layer containing a light-sensitive silver halide emulsion, wherein the first light-sensitive layer and/or a hydrophilic colloid layer contains a hydrazine compound, the second light-sensitive layer contains a redox compound capable of releasing a development inhibitor by oxidation, and the sensitivity of the first light-sensitive layer is higher by 0.2 to 1.0 than that of the second light-sensitive layer.

11 Claims, 1 Drawing Sheet

SILVER HALIDE PHOTOGRAPHIC MATERIAL

FIELD OF THE INVENTION

The present invention relates to a silver halide photographic material. In particular, the present invention relates to a silver halide photographic material suitable for forming ultra-hard negative images by a photomechanical process.

BACKGROUND OF THE INVENTION

In the field of photomechanical process technology, photographic materials with excellent original-producibility, stable processing solutions and simplified replenishment systems are required for the purpose of dealing with today's diversified and complicated print forms.

Originals to be employed in a line work process are often composed of phototypeset-letters, hand-written letters, illustrations and halftone dot image photographs. Accordingly, the original contains plural images having different concentrations and different line widths in combination. Photomechanical cameras and photographic materials suitable for finishing the images from such originals with good reproducibility as well as image-forming methods applicable to such photographic materials are earnestly desired in this technical field.

For the photomechanical process of producing catalogs or large-sized posters, enlargement or reduction of dot image photographs is widely used. In the photomechanical process using enlarged dot images, the dots become coarsened to give blurred photoprints. On the other hand, in the photomechanical process of forming reduced photoprints, fine dots with an enlarged ratio of lines/inch are to be photographed. Accordingly, an image-forming method with a much broader latitude assuring the formation of fine black dots in the white background and fine white dots in the black background is desired for the purpose of maintaining the reproducibility of halftone dot images in the photomechanical process.

As the light source for a photomechanical camera, a halogen lamp or xenon lamp is employed. In order to obtain a sufficient photographing sensitivity to the light source, the photographic material to be employed in the photomechanical process is generally ortho-sensitized. However, it was found that the ortho-sensitized photographic materials are much more influenced by chromatic aberrations of the lens, and therefore the quality of the images to be formed are frequently worsened by such influence. It was further found that the deterioration of image quality is more noticeable where a xenon lamp is used as the light source.

As a system of satisfying the demand for an image-forming method with a broad latitude, a method is known where a lith-type silver halide photographic material composed of silver chlorobromide (having a silver chloride content of at least 50 mol % or more) is processed with a hydroquinone-containing developer where the effective concentration of the sulfite ion therein is extremely lowered (generally, to 0.1 mol/liter or less) to thereby obtain a line image or halftone dot image having a high contrast and a high blackened density where the image portions and the non-image portions are clearly differentiated from each other. However, the method has various drawbacks. Specifically, since the sulfite concentration in the developer to be employed in the method is low, development is extremely unstable due to aerial oxidation. For the purpose of stabilizing the activity of the processing solution, various means have been employed. In addition, processing speed is extremely slow, and the working efficiency is poor under the current situation.

Accordingly, an improved image-forming system is desired, which is free from the instability of the image formation in the above-mentioned development method (lith-development system) and which may be processed with a processing solution having excellent storage stability to provide photographic images having ultra-hard photographic characteristics. As one example, a system of forming an ultra-hard negative image having a gamma value of more than 10 has been proposed, for example, in U.S. Pat. Nos. 4,166,742, 4,168,977, 4,221,857, 4,224,401, 4,243,739, 4,272,606 and 4,311,781, where a surface latent image-type silver halide photographic material containing a particular acyl hydrazine compound is processed with a developer having an excellent storage stability which contains a sulfite preservative in an amount of 0.15 mol/liter or more and has a pH value of from 11.0 to 12.3. The above proposed image-forming system is characterized in that a silver iodobromide or silver chloroiodobromide-containing photographic material can be processed, whereas only a silver chlorobromide photographic material having a high silver chloride content can be processed by the conventional ultra-hard image-forming method.

The above proposed image-forming system is excellent in the point that an image with sharp halftone dot image quality is formed, the process proceeds stably at a high speed, and the reproducibility of the original used is good. However, a further improved system with a further elevated original reproducibility is still desired for the purpose of satisfactorily dealing with today's diversified print forms.

Photographic materials containing a redox compound capable of releasing a photographically useful group by oxidation are mentioned in JP-A-56-153336, 61-156043, 61-230135 and 62-296138, where increased gradation reproducing latitude is intended. (The term "JP-A" used herein means an unexamined published Japanese patent application.) However, it has been found that redox compounds incorporated into these proposed photographic materials are inconvenient because they interfere with the hard contrast of images formed where the materials are processed in an ultra-hard processing system. Therefore, the compounds could not display the characteristics of an ultra-hard processing system.

SUMMARY OF THE INVENTION

A first object of the present invention is to provide a photographic material capable of producing a hard contrast image with high stability.

A second object of the present invention is to provide a photographic material capable of providing a hard contrast image having a good halftone image quality and an excellent original reproducibility.

These and other objects of the present invention have been attained by a silver halide photographic material having on a support a first light-sensitive layer containing a light-sensitive silver halide emulsion and, separate from the first light-sensitive layer, a second light-sensitive layer containing a light-sensitive silver halide emulsion, in which a hydrazine compound is contained in the first light-sensitive layer and/or a hydrophilic colloid layer containing no light-sensitive silver emulsion provided on the support, a redox compound capable of releasing a development inhibitor by oxidation is contained in the second light-sensitive layer, and the sensitivity of the first light-sensitive layer is higher by 0.2 to 1.0 than that of the second light-sensitive layer.

BRIEF EXPLANATION OF THE DRAWING

The sole FIGURE shows super-imposed letter images formed by contact exposure, where (a) is a transparent or semitransparent support, (b) is a line original in which the black portions indicate line images, (c) is a transparent or semitransparent support, (d) is a halftone original in which the black portions indicate dot images, and (e) is a dot-to-dot working photographic material in which the shadow portion indicates a light-sensitive layer.

DETAILED DESCRIPTION OF THE INVENTION

Figure 1:
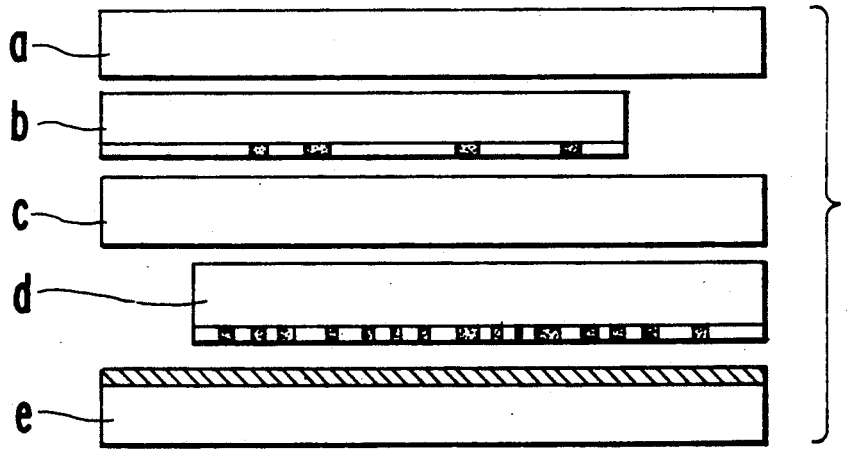

The present invention will be explained in detail hereunder.

The difference in the sensitivity between the first light-sensitive layer and the second light-sensitive layer in the photographic material of the present invention is represented by the difference ($\Delta\log E$) between the amount for exposure ($\log E$) necessary for imparting an optical density of 0.1 to the developed silver in each layer, and it is calculated by the following formula:

$$\Delta\log E = \log E_2 - \log E_1$$

wherein $E_1$ and $E_2$ are exposure amounts necessary for the first light-sensitive layer and the second light sensitive layer, respectively, to provide an optical density of 0.1 upon development.

A positive value of $\Delta\log E$ indicates that the sensitivity of the first light-sensitive layer is higher than that of the second light-sensitive layer.

The value of $\Delta\log E$ is preferably from 0.3 to 0.7.

The hydrazine compound in the photographic material of the present invention is preferably selected from compounds of formula (I):

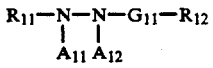

(I)

where $R_{11}$ represents an aliphatic group, or an aromatic group; $R_{12}$ represents a hydrogen atom, an alkyl group, an aryl group, an alkoxy group, an aryloxy group, an amino group, or a hydrazino group; G represents —CO—, —$SO_2$—, —SO—,

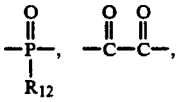

a thiocarbonyl group, or an iminomethylene group; and $A_{11}$ and $A_{12}$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group.

In formula (I), the aliphatic group represented by $R_{11}$ is preferably one having from 1 to 30 carbon atoms and is especially preferably a linear, branched or cyclic alkyl group having from 1 to 20 carbon atoms. The alkyl group may optionally be substituted.

In formula (I), the aromatic group represented by $R_{11}$ is preferably a monocyclic or dicyclic aryl or unsaturated heterocyclic group. The unsaturated heterocyclic group may be condensed with one or more aryl groups.

$R_{11}$ is more preferably an aryl group, especially preferably one containing benzene ring(s).

The aliphatic group or aromatic group represented by $R_{11}$ may optionally be substituted. Typical substituents include, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, an alkylsulfonyl group, an arylsulfinyl group, an alkylsulfinyl group, an arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphoric acid amido group, a diacylamino group,

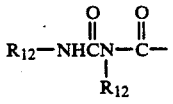

and an imido group. Preferred substituents among them are an alkyl group (preferably having from 1 to 20 carbon atoms), an aralkyl group (preferably having from 7 to 30 carbon atoms), an alkoxy group (preferably having from 1 to 20 carbon atoms), a substituted amino group (preferably an amino group as substituted by one or more alkyl groups having from 1 to 20 carbon atoms), an acylamino group (preferably having from 2 to 30 carbon atoms), a sulfonamido group (preferably having from 1 to 30 carbon atoms), a ureido group (preferably having from 1 to 30 carbon atom), and a phosphoric acid amido group (preferably having from 1 to 30 carbon atoms).

In formula (I), the alkyl group represented by $R_{12}$ preferably has from 1 to 4 carbon atoms. The aryl group represented by $R_{12}$ is preferably a monocyclic or dicyclic aryl group (for example, containing one or more benzene rings). The alkoxy group for $R_{12}$ preferably has from 1 to 20 carbon atoms (e.g., methoxy, ethoxy), and the aryloxy group for $R_{12}$ preferably has a monocyclic or dicyclic aryl moiety, particularly preferably those containing a benzene ring.

Where $G_{11}$ is —CO—, $R_{12}$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl), and it is especially preferably a hydrogen atom.

In formula (I), $G_{11}$ is most preferably —CO—.

$R_{12}$ may optionally be substituted. Examples of substituents which may be on $R_{12}$, include those mentioned as substituents for the group $R_{11}$ above.

$R_{12}$ may be such that it may cleave the moiety $G_{11}$–$R_{12}$ from the molecule of formula (I) to cause cyclization forming a cyclic structure containing the atoms of the $—G_{11}—R_{12}$ moiety. Examples of these $R_{12}$ groups are mentioned, for example, in JP-A-63-29751.

$A_{11}$ and $A_{12}$ are most preferably hydrogen atoms.

$R_{11}$ or $R_{12}$ in formula (I) may contain a ballast group or polymer which is generally used in passive photographic additives such as couplers. The ballast group as referred to herein is a group which has 8 or more carbon atoms and which is relatively inactive to photographic properties. For instance, it includes an alkyl group, an alkoxy group, a phenyl group, an alkylphenyl group, a phenoxy group, and alkylphenoxy group. Examples of the polymer referred to above include those described in JP-A-1-100530.

$R_{11}$ or $R_{12}$ in formula (I) may contain a group having a function of enhancing the adsorbability of the molecule of the formula to the surfaces of silver halide grains. Examples of such adsorbing groups are thiourea groups, heterocyclic thioamido groups, mercapto-heterocyclic groups and triazole groups as described in U.S. Pat. Nos. 4,385,108, 4,459,347, JP-A-59-195233, 59-200231, 59-201045, 59-201046, 59-201047, 59-201048, 59-201049, 61-170733, 61-270744, 62-948, 63-234244, 63-234246 and Japanese Patent Application No. 62-67501.

Specific examples of compounds of formula (I) for use in the present invention are mentioned below, which, however, are not intended to restrict the scope of the present invention.

(I-1)

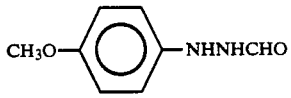

(I-2)

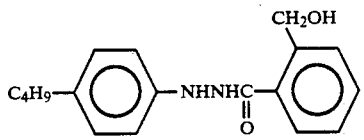

I-3

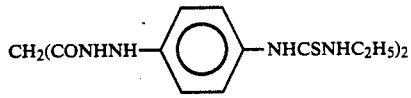

I-4

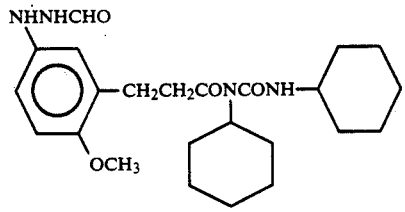

I-5

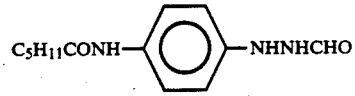

I-6

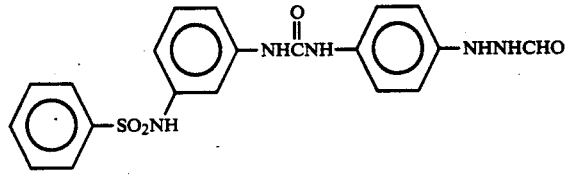

I-7

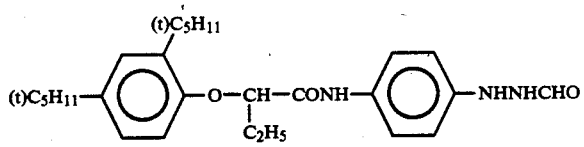

I-8

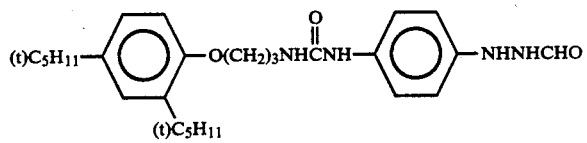

-continued
I-9
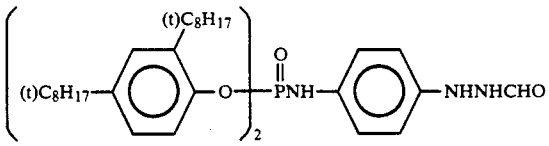
I-10
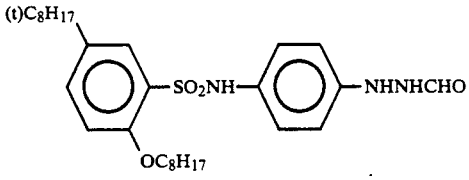
I-11
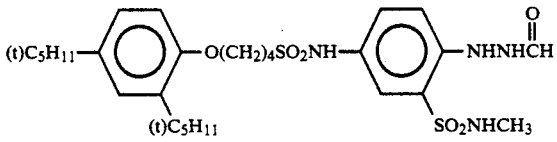
I-12
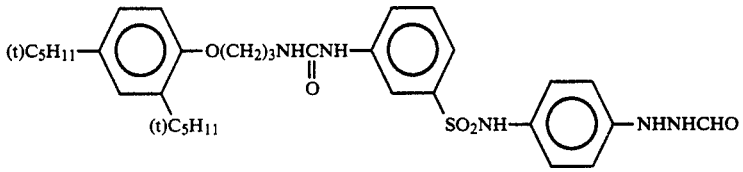
I-13
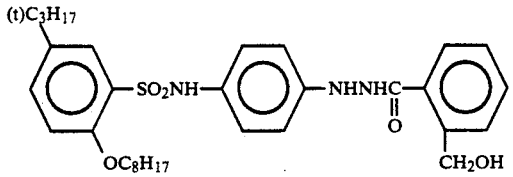
I-14
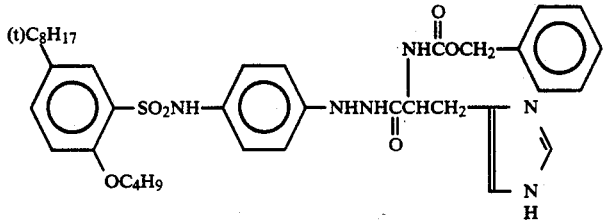
I-15
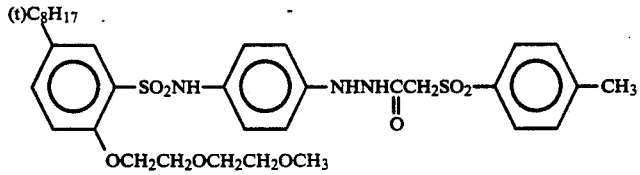
I-16
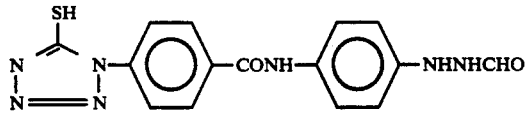
I-17
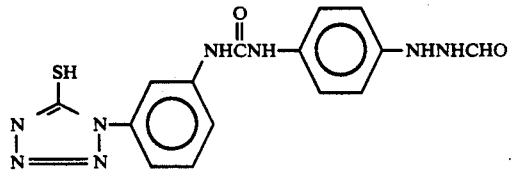

-continued
I-18
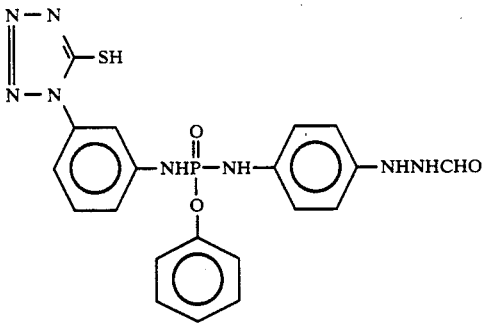
I-19
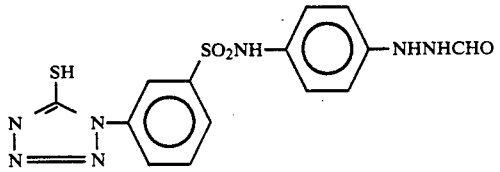
I-20
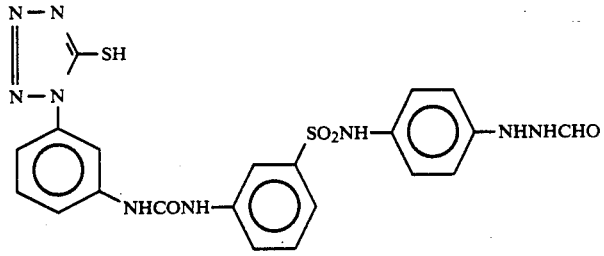
I-21
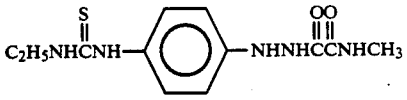
I-22
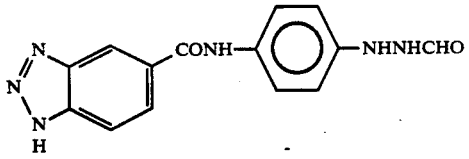
I-23
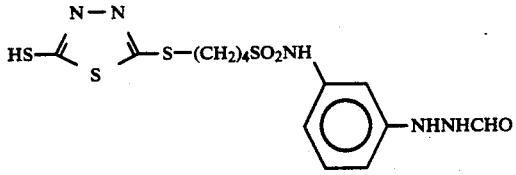
I-24
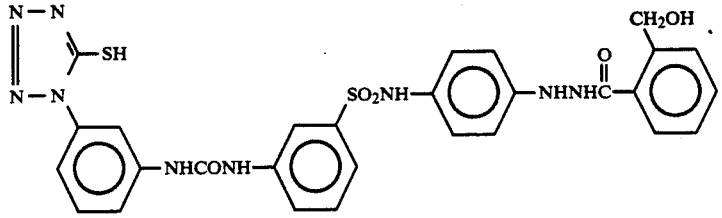

-continued

I-25

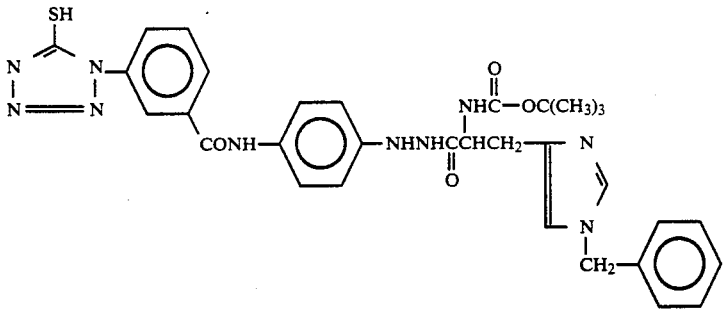

I-26

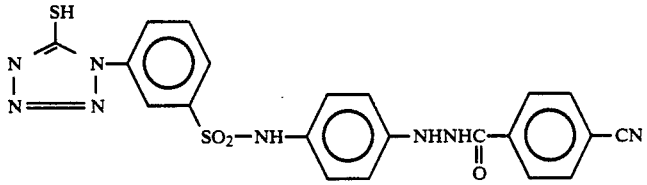

I-27

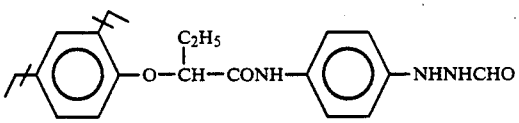

Other hydrazine compounds which may be used in the present invention include those described in RESEARCH DISCLOSURE Item 23516 (November, 1983, page 346) and literature referred to therein, as well as in U.S. Pat. Nos. 4,080,207, 4,269,929, 4,276,364, 4,278,748, 4,385,108, 4,459,347, 4,560,638, 4,478,928, British Patent 2,011,391B, JP-A-60-179734, 62-270948, 63-29751, 61-170733, 61-270744, 62-948, European Patent 217,310, U.S. Pat. No. 4,686,167, JP-A-62-178246, 63-32538, 63-104047, 63-121838, 63-129337, 63-223744, 63-234244, 63-234245, 63-234246, 63-294552, 63-306438, 1-100530, 1-105941, 1-105943, 64-10233, 1-90439, 1-276128, 1-283548, 1-280747, 1-283549, 1-285940, 2-2541, 2-77057 and Japanese Patent Application Nos. 63-179760, 1-18377, 1-18378, 1-18379, 1-15755, 1 16814, 1-40792, 1-42615, 1-42616, 1-123693, 1-126284.

The amount of the hydrazine compound to be added to the photographic material of the present invention is preferably from $1\times10^{-6}$ mol to $5\times10^{-2}$ mol, especially preferably from $1\times10^{-5}$ mol to $2\times10^{-2}$ mol, per mol of silver halide in the first light-sensitive layer.

Redox compounds capable of releasing a development inhibitor by oxidation, which are in the photographic material of the present invention, will be explained in detail below.

The redox group in the redox compounds is preferably a hydroquinone group, a catechol group, a naphthohydroquinone group, an aminophenol group, a pyrazolidone group, a hydrazine group, a hydroxylamine group or a reductone group. More preferably, it is a hydrazine group. Hydrazines which may be used in the present invention as redox compounds capable of releasing a development inhibitor by oxidation are preferably those represented by formula (IIa), (IIb) or (IIc). Compounds of formula (IIa) are especially preferred.

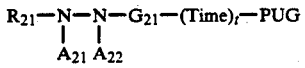

(IIa)

-continued

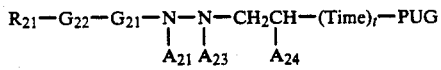

(IIb)

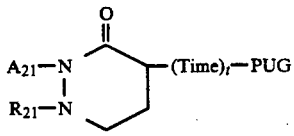

(IIc)

In these formulae, $R_{21}$ represents an aliphatic group or an aromatic group. $G_{21}$ represents —CO—,

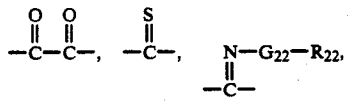

—SO—, —$SO_2$— or

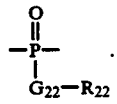

$G_{22}$ represents a chemical bond or represents —O—, —S— or

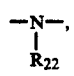

and $R_{22}$ represents a hydrogen atom or $R_{21}$.

$A_{21}$ and $A_{22}$ independently represents a hydrogen atom, an alkylsulfonyl group, an arylsulfonyl group or an acyl group, which may optionally be substituted. In formula (IIa), at least One of $A_{21}$ and $A_{22}$ must be a hydrogen atom. $A_{23}$ in formula (IIb) has the same meaning as $A_{21}$ or represents $$-CH_2-\underset{\underset{A_{24}}{|}}{CH}-(Time)_t-PUG.$$

$A_{24}$ represents a nitro group, a cyano group, a carboxyl group, a sulfo group or $-G_{21}-G_{22}-R_{21}$.

Time represents a divalent linking group; and t represents 0 or 1. PUG represents a development inhibitor group.

Formulae (IIa), (IIb) and (IIc) will be explained in more detail below.

In formulae (IIa), (IIb) and (IIc), the aliphatic group represented by $R_{21}$ is preferably a group having from 1 to 30 carbon atoms. Especially preferably, $R_{21}$ is a linear, branched or cyclic alkyl group having from 1 to 20 carbon atoms.

In formulae (IIa), (IIb) and (IIc), the aromatic group represented by $R_{21}$ is preferably a monocyclic or dicyclic aryl or an unsaturated heterocyclic group. The unsaturated heterocyclic group may optionally be condensed with one or more aryl groups to form a heteroaryl group.

For instance, the aryl group may be composed of a benzene ring, naphthalene ring, pyridine ring, quinoline ring and/or isoquinoline ring. Especially preferably, it contains one or more benzene rings.

$R_{21}$ is especially preferably an aryl group.

The alkyl, aryl or unsaturated heterocyclic group represented by $R_{21}$ may optionally be substituted. Typical substituents include for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, and a phosphoric acid amido group. Above all, preferred are a linear, branched or cyclic alkyl group (preferably having from 1 to 20 carbon atoms), an aralkyl group (preferably having from 7 to 30 carbon atoms), an alkoxy group (preferably having from 1 or 30 carbon atoms), a substituted amino group (preferably an amino group as substituted by one or more alkyl groups having from 1 to 30 carbon atoms), an acylamino group (preferably having from 2 to 40 carbon atoms), a sulfonamido group (preferably having from 1 to 40 carbon atoms), a ureido group (preferably having from 1 to 40 carbon atoms), and a phosphoric acid amido group (preferably having from 1 to 40 carbon atoms).

$G_{21}$ in formulae (IIa), (IIb) and (IIc) is preferably —CO— or $-SO_2-$, and most preferably, it is —CO—.

$A_{21}$ and $A_{22}$ are preferably hydrogen atoms; and $A_{23}$ is preferably a hydrogen atom or $$-CH_2-\underset{\underset{A_{24}}{|}}{CH}-(Time)_t-PUG.$$

In formulae (IIa), (IIb) and (IIc), Time represents a divalent linking group, which may have a timing-adjusting function.

The divalent linking group represented by Time is a group capable of releasing PUG from the moiety Time-PUG to be released from the oxidation product of the redox nucleus, by a one step reaction or via a reaction having plural steps.

Examples of the divalent linking group of Time include p-nitro-phenoxy derivatives capable of releasing PUG by intramolecular ring-closure reaction described in U.S. Pat. No. 4,248,962 (JP-A-54-145135); compounds of releasing PUG by ring-cleavage reaction followed by intramolecular ring-closure reaction described in U.S. Pat. No. 4,310,612 (JP-A-55-53330) and U.S. Pat. No. 4,358,252; succinic acid monoesters or analogues thereof capable of releasing PUG by an intramolecular ring-closure reaction of the carboxyl group along with the formation of an acid anhydride, described in U.S. Pat. Nos. 4,330,617, 4,446,216 and 4,483,919 and JP-A-59-121328; compounds capable of releasing PUG by electron transfer of the aryloxy or heterocyclic-oxy group via the conjugated double bond to form a quinomonomethane or an analogue thereof, as described in U.S. Pat. Nos. 4,409,323, 4,421,845, RESEARCH DISCLOSURE Item No. 2,228 (December, 1981), U.S. Pat. No. 4.416,977,(JP-A-57-135944) and JP-A-58-209736 and 58-209738; compounds capable of releasing PUG by electron transfer of the enamine structure moiety of the nitrogen-containing hetero ring from the gamma-position of the enamine, as described in U.S. Pat. No. 4,420,554, (JP-A-57-136640), JP-A-57-135945, 57-188035, 58-98728 and 58-209737; compounds capable of releasing PUG by an intramolecular ring-closure reaction of the hydroxyl group formed by electron transfer of the carbonyl group which is conjugated with the nitrogen atom of the nitrogen containing hetero ring, as described in JP-A-57-56837; compounds capable of releasing PUG with formation of aldehydes as described in U.S. Pat. No. 4,146,396 (JP-A-52-90932), JP-A-59-93442, 59-75475, 60-249148 and 60-249149; compounds capable of releasing PUG with decarbonylation of the carboxyl group, as described in JP-A-51-146828, 57-179842 and 59-104641; compounds having $-O-COOCR_aR_b-PUG$ (where $R_a$ and $R_b$ independently represent a monovalent group) which release PUG by decarbonylation followed by formation of aldehydes; compounds capable of releasing PUG with the formation of isocyanates, as described in JP-A-60-7429; and compounds capable of releasing PUG by a coupling reaction with the oxidation product of a color developing agent, as described in U.S. Pat. No. 4,438,193.

Examples of divalent linking groups of Time are also described in JP-A-61-236549 and 1-269936.

PUG represents a group having a development-inhibiting activity as $(Time)_t$-PUG or as PUG.

The development inhibitor represented by PUG or $(Time)_t$-PUG may be a known development inhibitor containing hetero atoms, and is bonded to the compound via the hetero atom. Examples of such a development inhibitor are described, for example, in C. M. E. Mees and T. H. James, *The Theory of Photographic Processes,* 3rd Ed. (published by Macmillan Co., 1966), pages 344 to 346.

The development inhibitor of PUG may optionally be substituted. Examples of the substituents are a nitro group, a phosphono group, a phosphinico group and those mentioned above as substituents of the group $R_{21}$. The substituents may further be substituted.

Preferred substituents for the development inhibitor of PUG are a nitro group, a sulfo group, a carboxyl group, a sulfamoyl group, a phosphono group, a phosphinico group and a sulfonamido group.

In formulae (IIa), (IIb) and (IIc), $R_{21}$ or —(Time)$_r$—PUG may have a ballast group which is generally used in passive photographic additives such as couplers or may also have a group for accelerating adsorption of the compound of formula (IIa), (IIb) and (IIc) to silver halide, if desired.

The ballast group which can be used is an organic group which may have a sufficient molecular weight with respect to the compound of formula (IIa), (IIb) and (IIc) so that the compound could not substantially diffuse to the other layers or to processing solutions. The ballast group is composed of one or more of an alkyl group, an aryl group, a heterocyclic group, an ether group, a thioether group, an amido group, a ureido group, a urethane group and a sulfonamido group. Preferably, the ballast group is a substituted benzene ring-containing ballast group, especially a branched alkyl group-substituted benzene ring-containing ballast group.

Example of the group having the function of accelerating the adsorption of the compound of formula (IIa), (IIb) and (IIc) to silver halides are cyclic thioamido groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidazoline-2-thione; linear thioamido groups; aliphatic mercapto groups; aromatic mercapto groups; heterocyclic mercapto groups (when a nitrogen atom is adjacent to the carbon atom that is bonded to —SH, the heterocyclic mercapto groups have the same meaning as the cyclic thioamido heterocyclic mercapto groups which are tautomers of the groups, and specific examples of such heterocyclic mercapto groups are the same as those mentioned above for the cyclic thioamido groups); disulfido bond-having groups, 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazolines, oxazoles, oxazolines, thiadiazoles, oxathiazoles, triazines, azaindenes; as well as heterocyclic quaternary salts such as benzimidazoliums.

These groups may further be substituted by suitable substituent(s), if desired.

As examples of the substituents, those mentioned for the group $R_{21}$ as above are referred to.

Specific examples of the compounds of the above-mentioned formulae (IIa), (IIb) and (IIc) which are suitable in the present invention are illustrated below, which, however, are not limitative.

II-1

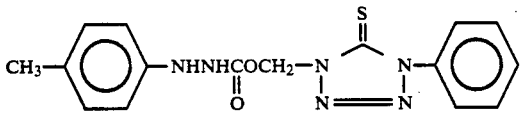

II-2

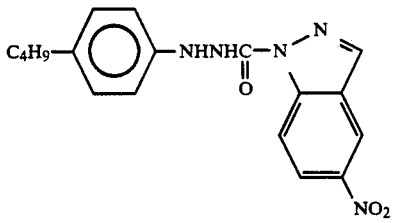

II-3

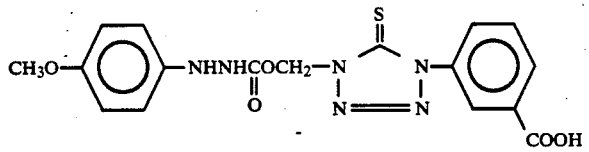

II-4

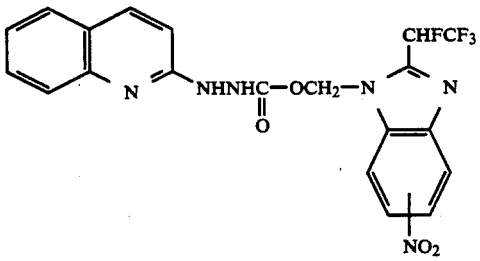

II-5

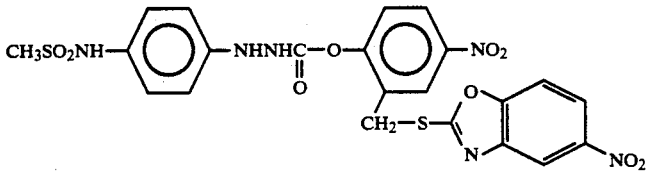

-continued
II-6
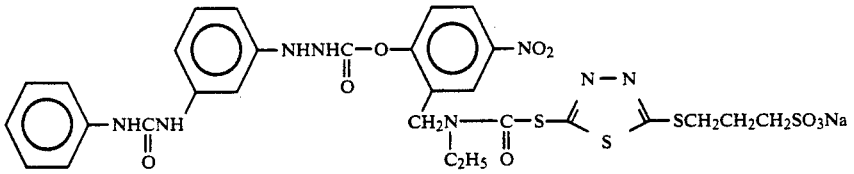
II-7
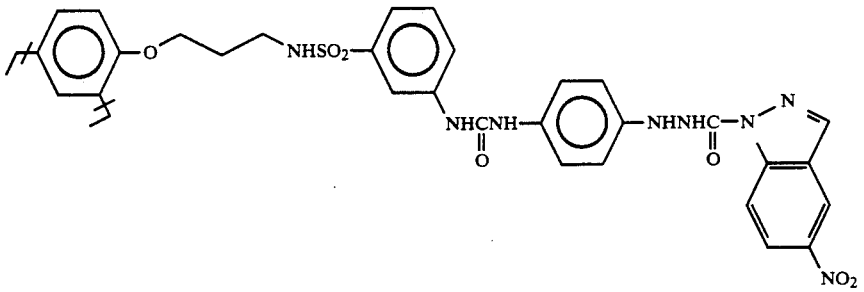
II-8
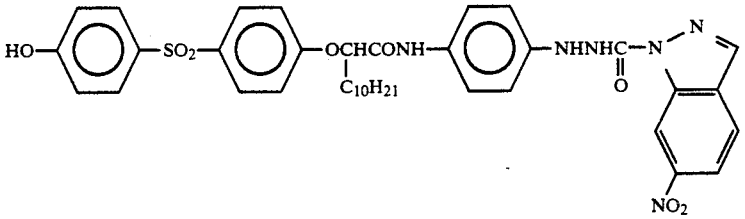
II-9
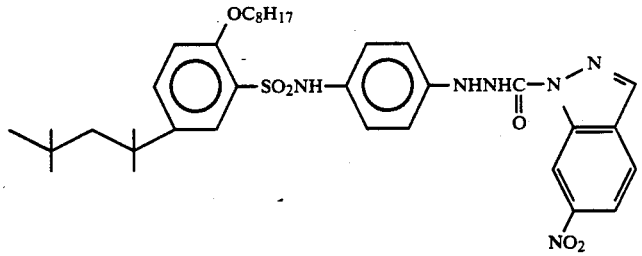
II-10
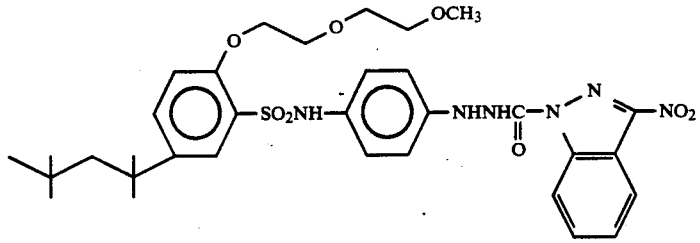
II-11
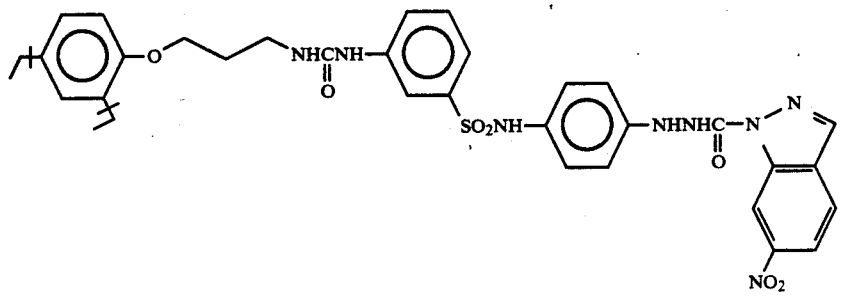

-continued
II-12
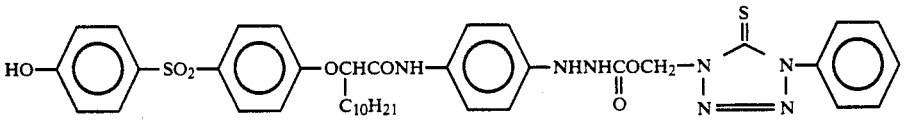
II-13
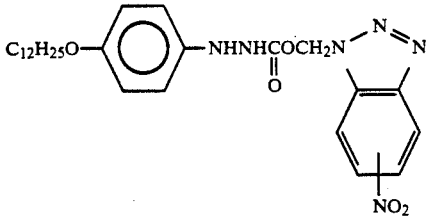
II-14
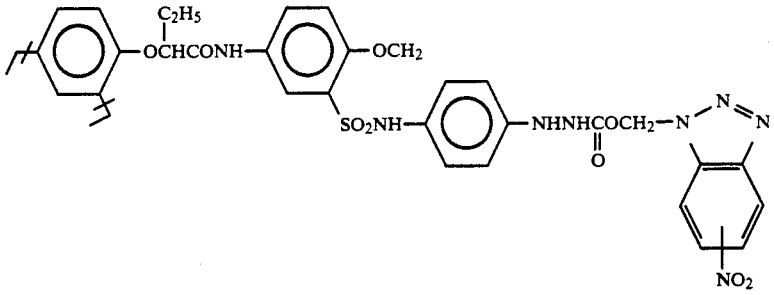
II-15
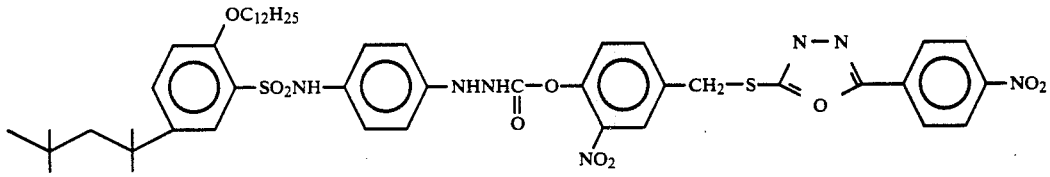
II-16
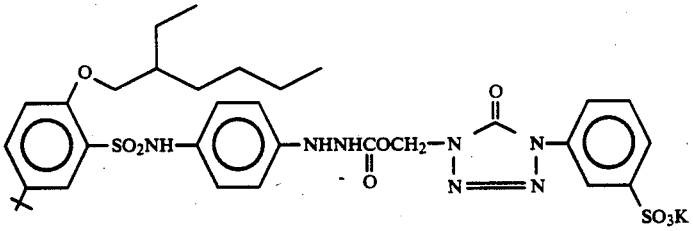
II-17
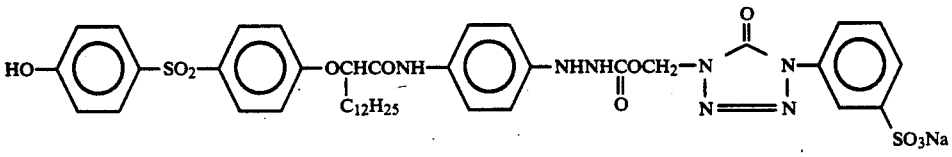
II-18
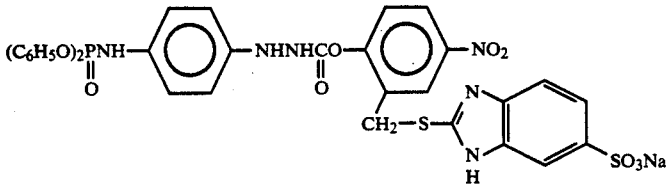

-continued
II-19
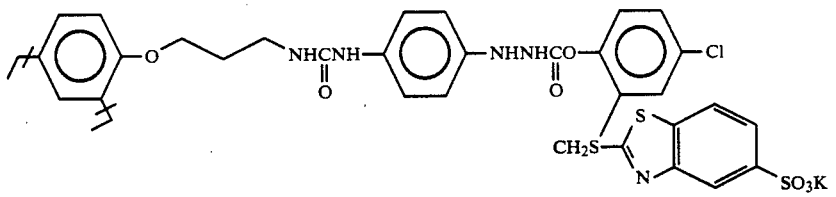
II-20
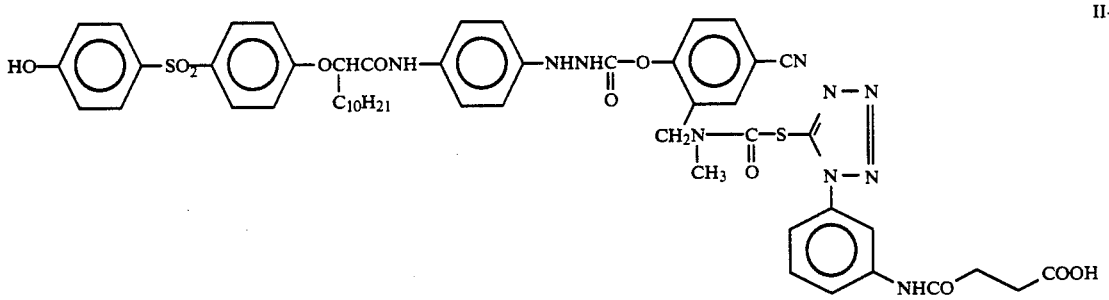
II-21
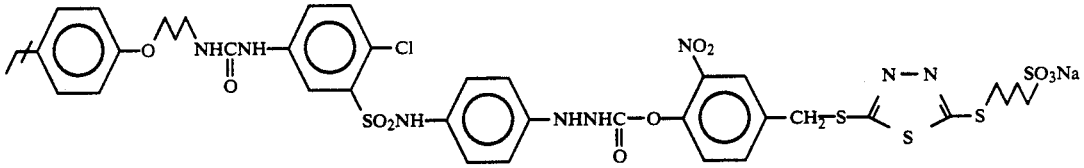
II-22
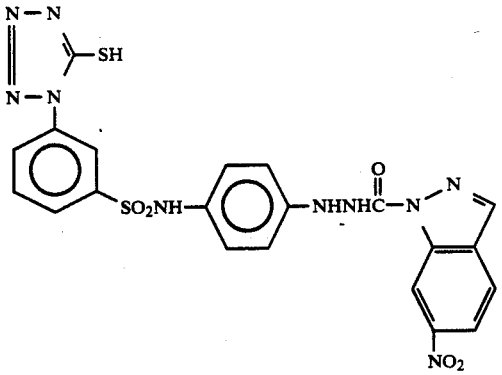
II-23
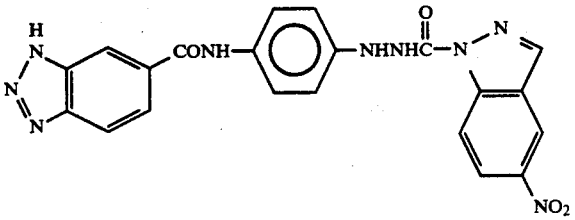

-continued
II-24
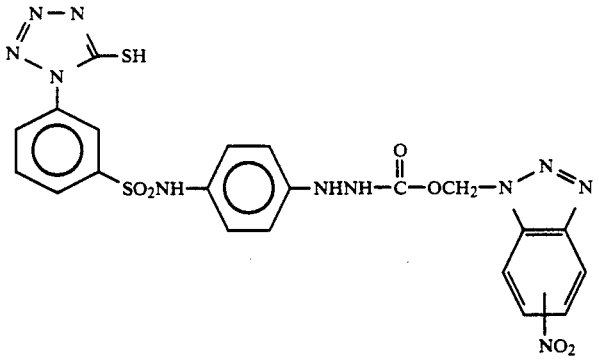
II-25
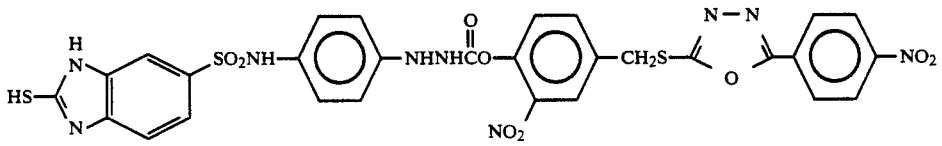
II-26
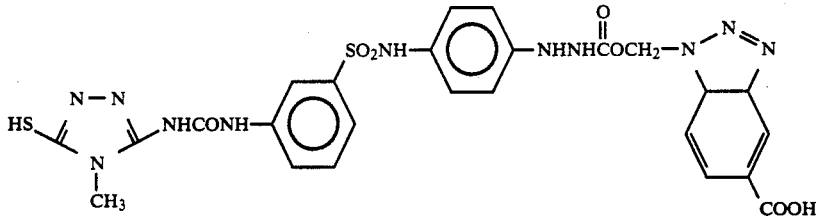
II-27
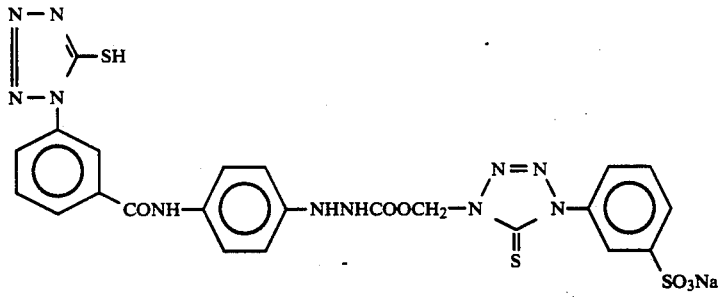
II-28
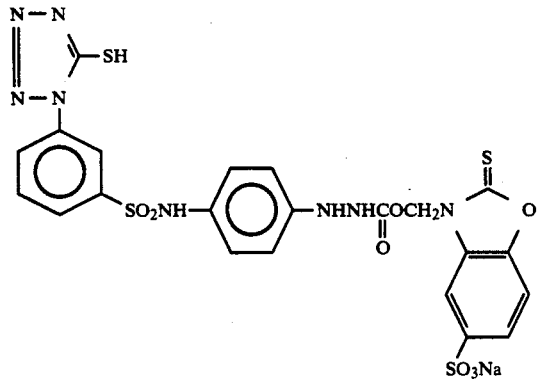

-continued
II-29
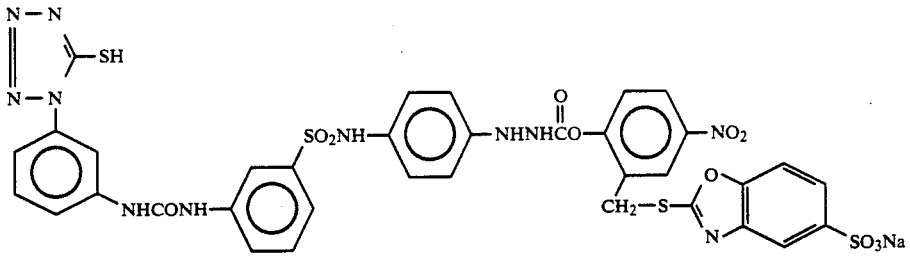
II-30
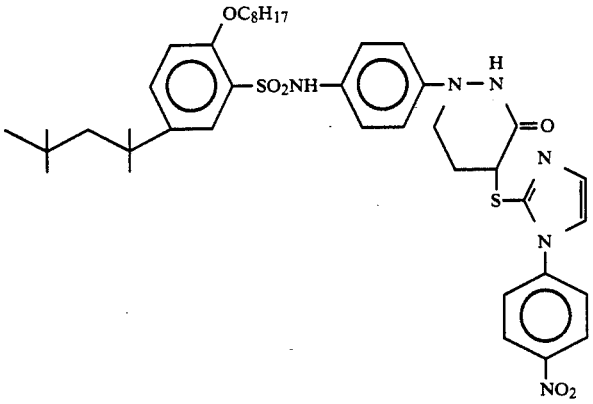
II-31
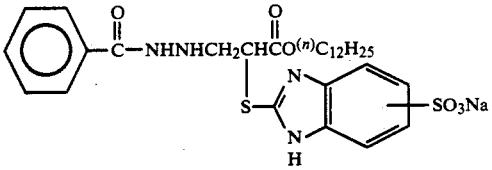
II-32
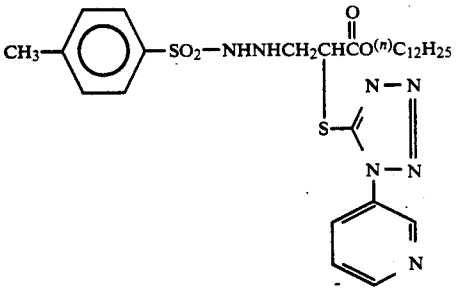
II-33
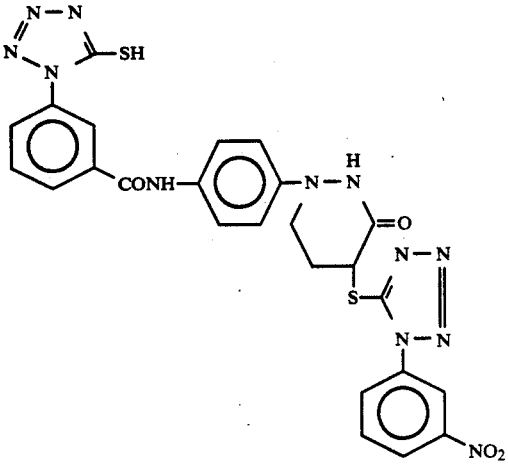

-continued

II-34

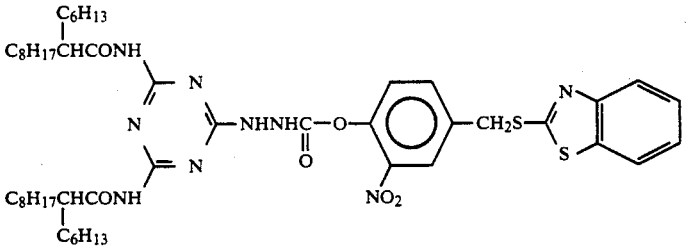

II-35

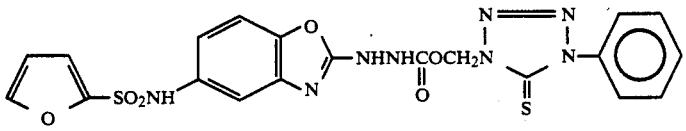

II-36

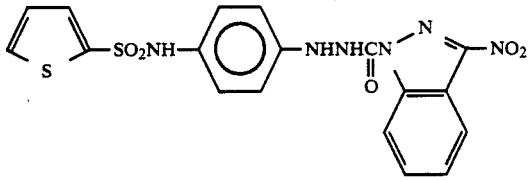

II-37

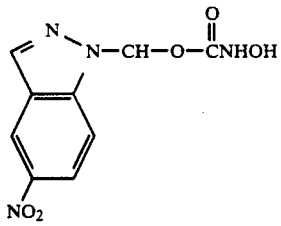

Other redox compounds usable in the present invention are, for example, described in JP-A-61-213847, 62-260153, Japanese Patent Applications 1-102393, 1-102394, 1-102395 and 1-114455.

Methods of preparing redox compounds usable in the present invention are described, for example, in JP-A-61-213847, 62-260153, U.S. Pat. No. 4,684,604, JP-A-1-269936, U.S. Pat. Nos. 3,379,529, 3,620,746, 4,377,634, 4,332,878, JP-A-49-129536, 56-153336, and 56-153342.

The amount of redox compound(s) to be in the photographic material of the present invention may be from $1\times10^{-6}$ to $5\times10-2$ mol, more preferably from $1\times10^{-5}$ to $1\times10^{-2}$ mol per mol of silver halide in the second light-sensitive layer.

To incorporate the redox compound in the photographic material of the present invention, the redox compound may be dissolved in a suitable water-miscible organic solvent, for example, alcohols (e.g., methanol, ethanol, propanol, fluorinated alcohols), ketones (e.g., acetone, methyl ethyl ketone), dimethylformamide, dimethylsulfoxide, or methyl cellosolve.

As another means, the compound may be mechanically formed into an emulsified dispersion by means of a well known emulsifying and dispersing method of using an oil such as dibutyl phthalate, tricresyl phosphate, glyceryl triacetate or diethyl phthalate and an auxiliary solvent such as ethyl acetate or cyclohexanone. As still another means, a powder of the redox compound may be dispersed in water by using a ball mill or colloid mill or by the action of ultrasonic waves, or by means of any well-known solid dispersing method.

In the photographic material of the present invention, it is preferred that the light-sensitive wavelength range of the second light-sensitive layer includes the light-sensitive wavelength range of the first light-sensitive layer and that the former is broader than the latter.

The light-sensitive wavelength range of the second light-sensitive layer may be broader than that of the first light-sensitive layer either to the side of a short wavelength range or to the side of a long wavelength range.

For instance, the above condition is satisfied in various cases such as where the first light-sensitive layer is sensitive to only the intrinsic sensitivity range of the silver halide in the layer and the second light-sensitive layer is sensitive to the intrisic range and a blue light range, or where the first light-sensitive layer is sensitive to a green light range and the second light-sensitive layer is sensitive to both a green light range and a blue light range, or where the first light-sensitive layer is sensitive to a green light range and the second light-sensitive layer is sensitive to both a green light range and a red light range.

Above all, the case where the first light-sensitive layer is sensitive to a green light range and the second light-sensitive layer is sensitive to both a green light range and a blue light range is especially preferred.

More preferably, with respect to the light-sensitive layers of the photographic material of the present invention, the second light-sensitive layer material has an additional color-sensitivity peak which is different from the color-sensitivity peak of the first light-sensitive layer and which is remote from the latter by 30 nm or more, more preferably 50 nm or more, especially preferably 70 nm or more. It is preferred that the sensitivity of the inhibitor-releasing layer (second light-sensitive layer) may easily be controlled without interfering with the sensitivity of the first light-sensitive layer as much as possible.

The photographic material of the present invention may contain a green-sensitizing dye, which has the capability of adsorbing to silver halide grains and has an absorption maximum in the range of from 450 to 580 nm.

Usable dyes include cyanine dyes, merocyanine dyes, complex cyanine dyes, complex merocyanine dyes, holopolar cyanine dyes, hemicyanine dyes, styryl dyes and hemioxonole dyes. Especially useful dyes are cyanine dyes, merocyanine dyes and complex merocyanine dyes. These dyes can contain any and every nuceli which are generally used in cyanine dyes as basic heterocyclic nuclei. Specifically, there are mentioned pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, as well as condensed nuclei formed by fusing alicyclic hydrocarbon rings to these nuclei and condensed nuclei formed by fusing aromatic hydrocarbon rings thereto, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei and quinoline nuclei. These nuclei may be substituted on the carbon atom(s).

Examples of 5- or 6-membered heterocyclic nuclei that may be present in the merocyanine dyes or complex merocyanine dyes include ketomethylene structure-containing nuclei, such as pyrazolin-5-one nuclei, thiohydantoin nuclei, 2-thioxazolidine-2,4-dione nuclei, thiazolidine-2,4-dione nuclei, rhodanine nuclei and thiobarbituric acid nuclei.

Specific examples of suitable dyes are described in RESEARCH DISCLOSURE, Vol. 176, Item No. 17643 (December, 1978), page 23, and U.S. Pat. Nos. 4,425,425 and 4,425,426.

Above all, cyanine dyes of formula (III) and merocyanine dyes of formula (IV) are especially preferred.

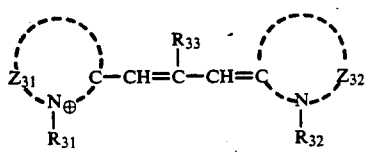

(III)

In formula (III), $Z_{31}$ and $Z_{32}$ independently represent an atomic group necessary for forming a thiazole nucleus, a thiazoline nucleus, a benzothiazole nucleus, a naphthothiazole nucleus, an oxazole nucleus, a benzoxazole nucleus, an oxazoline nucleus, a naphthoxazole nucleus, an imidazole nucleus, a benzimidazole nucleus, an imidazoline nucleus, a selenazole nucleus, a selenazoline nucleus, a benzoselenazole nucleus or a naphthoselenazole nucleus.

$R_{31}$ and $R_{32}$ independently represent a substituted or insubstituted alkyl group, provided that at least one of $R_{31}$ and $R_{32}$ has a sulfo group or a carboxyl group.

$R_{33}$ represents a hydrogen atom or an alkyl group having from 1 to 3 carbon atoms.

The nucleus to be formed by $Z_{31}$ or $Z_{32}$ may have substituent(s), as well known in the technical field of cyanine dyes. Examples of such substituents include an alkyl group, an alkoxy group, an alkoxycarbonyl group, an aryl group, an aralkyl group, and a halogen atom.

$R_{31}$ and $R_{32}$ may be same as or different from each other The alkyl group represented by $R_3$I or $R_{32}$ is preferably one having from 1 to 8 carbon atoms (excluding carbon atoms in the substituents thereon), such as methyl group, ethyl group, propyl group, butyl group, pentyl group or heptyl group. Substituents for the substituted alkyl group represented by $R_{31}$ or $R_{32}$, are, for example, a carboxyl group, a sulfo group, a cyano group, a halogen atom (e.g., fluorine, chlorine, bromine), a hydroxyl group, an alkoxycarbonyl group (preferably having 8 or less carbon atoms, such as methoxycarbonyl, ethoxycarbonyl, benzyloxycarbonyl), an alkoxy group (preferably having 7 or less carbon atoms, such as methoxy, ethoxy, propoxy, butoxy, benzyloxy), an aryloxy group (e.g., phenoxy, p-tolyloxy), an acyloxy group (preferably having 3 or less carbon atoms, such as acetyloxy, propionyloxy), an acyl group (preferably having 8 or less carbon atoms, such as acetyl, propionyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). The substituted alkyl group preferably has 6 or less carbon atoms.

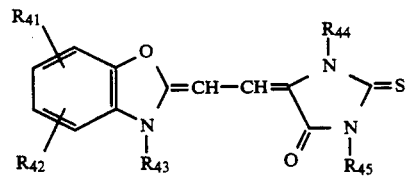

(IV)

In formula (IV), $R_{41}$ and $R_{42}$ independently represent a hydrogen atom, a halogen atom (e.g., chlorine, bromine), a substituted or unsubstituted alkyl group having from 1 to 8 carbon atoms (e.g., methyl, ethyl, hydroxyethyl), a substituted or unsubstituted alkoxy group having from 1 to 8 carbon atoms (e.g., methoxy, ethoxy), a phenyl group, a naphthyl group, a sulfo group or a carboxyl group. $R_{41}$ and $R_{42}$ may be bonded to each other to form a 6-membered ring, which may optionally be substituted by one or more substituents selected from a halogen atom, a lower alkyl group, a hydroxyl group, a hydroxyalkyl group, a phenyl group, an alkoxy group and a carboxyl group.

$R_{43}$ represents an substituted or unsubstituted alkyl group (e.g., methyl, ethyl, sulfoethyl, sulfopropyl, sulfoamidoethyl, sulfobutyl), or a substituted or unsubstituted alkenyl group (e.g., allyl).

$R_{44}$ represents substituted a or unsubstituted alkyl group having from 1 to 12 carbon atoms. Preferred substituents are a hydroxyl group and a carbamido group. The alkyl group may be interrupted by —O—, —OCO—, —NH— or —N— in the carbon chain.

$R_{45}$ represents a phenyl or pyridyl group optionally substituted by one or more substituents selected from a halogen atom (e.g., chlorine, bromine), a lower alkyl group (e.g., methyl, ethyl), a hydroxyl group, a hydroxyalkyl group (e.g., hydroxyethyl), an alkoxy group (e.g., methoxy, ethoxy), a sulfo group and a carboxyl group.

Sensitizing dyes of formula (III) as described above can be produced by known methods described, for example, in F. M. Hamer, "Heterocyclic Compounds-Cyanine dyes and related compounds", published by John Wiley & Sons, New York, London (1964); D. M. Sturmer, "Helerocyclic Compounds-Special topics in heterocyclic chemistry", Chapter 18, Section 14, pp.482–515, published by John Wiley & Sons, New York, London (1977); and D. J. Fry, "Rodd's Chemistry of Carbon Compounds", Chapter 15, pp.369–422, 2nd Ed. vol IV, part B (1977), and ibid, Chapter 15, pp.269–296, 2nd Ed. vol.IV part B (1985), published by Elsvier Science Publishing Co., Ltd., New York.

Sensitizing dyes of formula (IV) can be easily be produced by known methods, as described, for example in JP-A-50-33828, 54-45015, 56-25728, U.S. Pat. Nos. 2,742,833, 2,756,148 and 3,567,458.

Specific examples of dyes of formulae (III) and (IV) are mentioned below, which, however, are not limitative.

III-1)

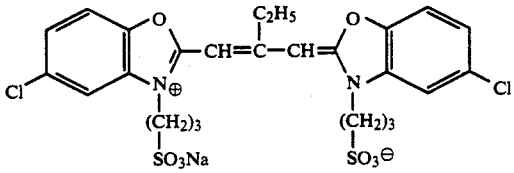

III-2)

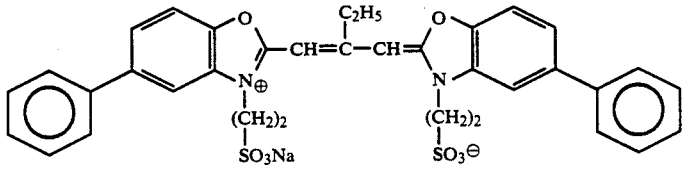

III-3)

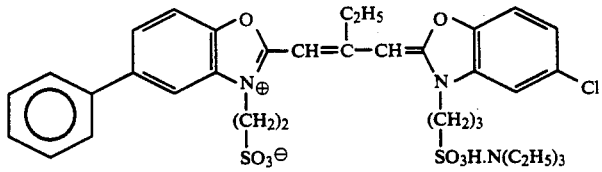

III-4)

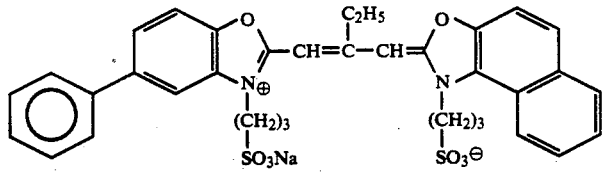

III-5)

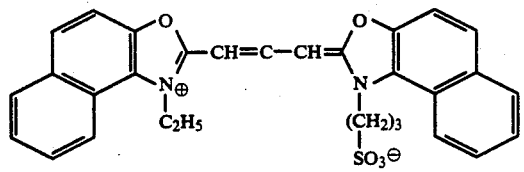

III-6)

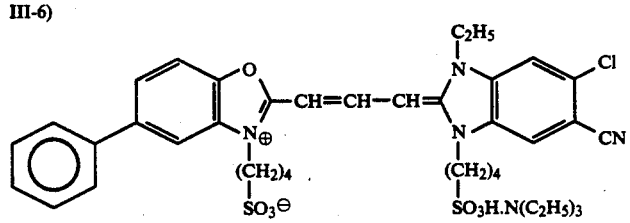

III-7)

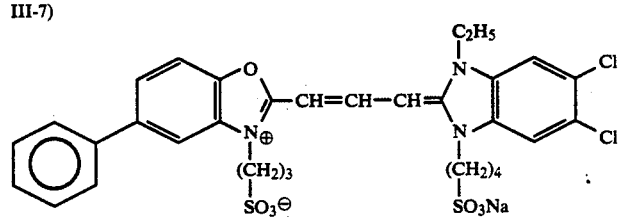

-continued
III-8)
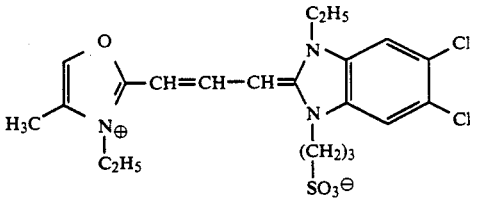
III-9)
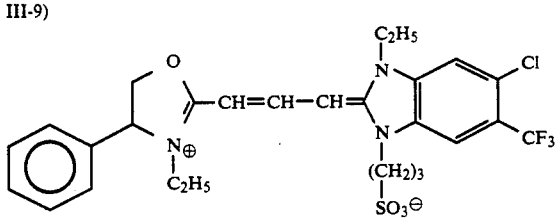
III-10)
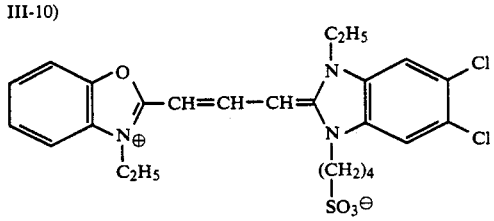
III-11)
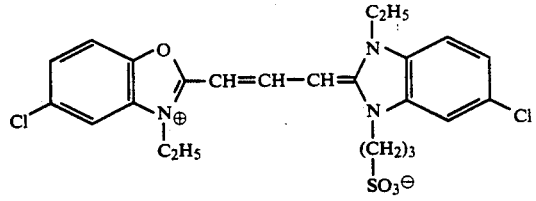
III-12)
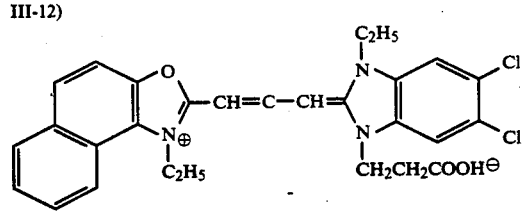
III-13)
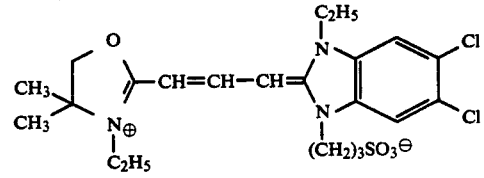
III-14)
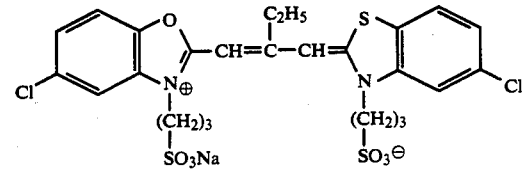
III-15)

-continued

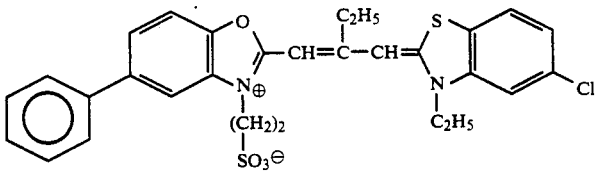

III-16)

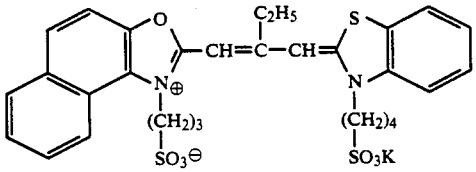

III-17)

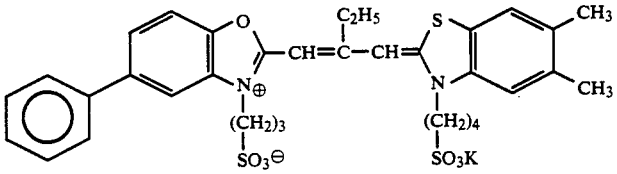

III-18)

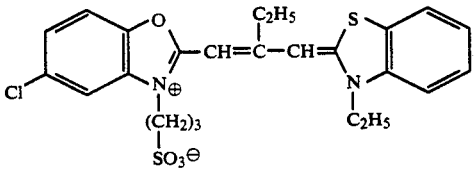

III-19)

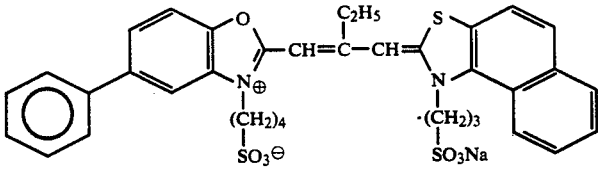

III-20)

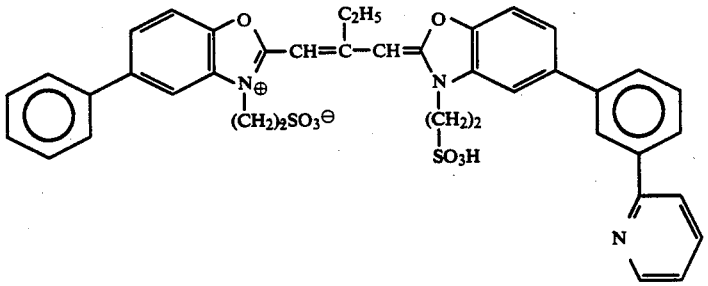

(IV-1) 1-(2-diethylaminoethyl)-5-[(ethylnaphtho[2,1-d]oxazolin-2-ylidene)ethylidene]-3-(pyradin-2-yl)-2-thiohydantoin (IV-2) 1-(2-diethylaminoethyl)-3-(pyridin-4-yl)-5-[3-ethyl-2-benzoxazolinidene)ethylidene]-2-thiohydantoin (IV-3) 1-(2-hydroxyethyl)-3-(4-sulfobutyl-pyridin-2-yl)-5-[(3-sulfopropyl-2-benzoxazolindene)ethylidene]-2-thiohydantoin sodium salt (IV-4) 1-(2-acetylbutyl)-3-(pyridin-2-yl)-5-[(3-sulfodiehthyl-2-benzoxazolinidene)ethylidene]-2-thiohydantoin sodium salt (IV-5) 1-(2-hydroxyethyl-3-(pyridin-2-yl)-5-[(3-sulfopropyl-2-benzoxazolinidene)ethylidene]-2-thiohydandoin sodium salt (IV-6) 1-(2,3-dihydroxypropyl)-3-(pyridin-2-yl)-5-[(3-sulfoamidoehthyl-2-benzoxazolinidene)ethylidene]-2-thiohydantoin sodium salt (IV-7) 1-(2-hydroxyethoxyethyl)-3-(pyridin-2-yl)-5-[(3-sulfobutyl-5-chloro-2-benzoxazolinidene)ethylidene]-2-thiohydantoin sodium salt (IV-8) 1-(2-hydroxyethoxyethoxyethyl)-3-(pyridin-2-yl)-5-[(3-sulfobutyl-5-chloro-2-benzoxazolinidene)ethylidene]-2-thiohydandoin sodium salt (IV-9) 1-(2-hydroxyethylaminoethyl)-3-(4-chloropyridin-2-yl)-5-[(3-sulfobutyl-5-methyl-2-benzoxazolinidene)-ethylidene)-2-thiohydandoin sodium salt (IV-10) 1-(2-hydroxyethoxyethyl)-3-(p-ethoxypyridin-2yl-5-[(3-sulfobutylnaphtho[2,1-d]oxazolin-2-ylidene)ethylidene]-2-thiohydantoin sodium salt (IV-11) 1-(2-carbamidoethyl)-3-(4-methylpyridin-3-yl)-5-[(3-sulfobutylnaphtho[2,1-d]oxazolin-2-ylidene)ethylidene]-2-thiohydantoin sodium salt As blue-sensitizing dyes, compounds of formula (V) are preferably used in the present invention.

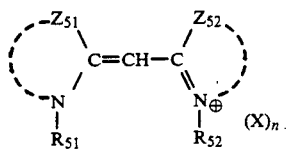

(V)

In formula (V), $Z_{51}$ and $Z_{52}$ independently represent a non-metallic atomic group necessary for forming a benzoxazole nucleus, a benzothiazole nucleus, a benzoselenazole nucleus, naphthoxazole nucleus, a naphthothiazole nucleus, a naphthoselenazole nucleus, a thiazole nucleus, a thiazoline nucleus, an oxazole nucleus, a selenazole nucleus, a selenazoline nucleus, a pyridine nucleus or a quinoline nucleus $R_{51}$ and $R_{52}$ independently represent an alkyl group or an aralkyl group. X represents a pair ion for charge balance of the formula; and n represents 0 or 1.

With respect to the groups represented by $Z_{51}$ and $Z_{52}$ in formula (V), the benzothiazole nucleus to be formed by the group includes, for example, benzothiazole, 5-chlorobenzothiazole, 5-nitrobenzothiazole, 5-methylbenzothiazole, 6-bromobenzothiazole, 5-iodobenzothiazole, 5-phenylbenzothiazole, 5-methoxybenzothiazole, 6-methoxybenzothiazole, 5-carboxybenzothiazole, 5-ethoxycarbonylbenzothiazole, 5-fluorobenzothiazole, 5-chloro-6-methylbenzothiazole, and 5- trifluoromethylbenzothiazole; the naphthothiazole nucleus includes, for example, naphtho[2,1-d]thiazole, naphtho[1,2-d]thiazole, naphtho[2,3-d]thiazole, 5-methoxynaphtho[1,2-d]thiazole, and 5-methoxynaphtho[2,3-d]thiazole; the benzoselenazole nucleus includes, for example, benzoselenazole, 5-chlorobenzoselenazole, 5-methoxybenzoselenazole, 5-hydroxybenzoselenazole, and 5-chloro-6-methylbenzoselenazole; the naphthoselenazole nucleus includes, for example, naphtho[1,2-d]selenazole, and naphtho[2,1-d]selenazole; the thiazole nucleus includes, for example, thiazole, 4-methylthiazole, 4-phenylthiazole, and 4,5-dimethylthiazole; and the thiazoline nucleus includes, for example, thiazoline, and 4-methylthiazoline.

In addition with respect to the groups represented by $Z_{51}$ and $Z_{52}$ in formula (V), the benzoxazole nucleus to be formed by the group includes, for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-ethoxybenzoxazole, 5-trifluoromethylbenzoxazole, 5-hydroxybenzoxazole, 5-carboxybenzoxazole, 6-methylbenzoxazole, 6-chlorobenzoxazole, 6-methoxybenzoxazole, 6-hydroxybenzoxazole, and 5,6-dimethylbenzoxazole; and the naphthoxazole nucleus includes, for example, naphtho[2,1-d]oxazole, naphtho[1,2-d]oxazole, naphtho[2,3-d]oxazole, and 5-methoxynaphtho[1,2-d]oxazole.

Further with respect to $Z_{51}$ and $Z_{52}$. the Oxazole nucleus to be formed by the group represented by $Z_{51}$ and $Z_{52}$ includes, for example, oxazole, 4-methyloxazole, 4-phenyloxazole, 4-methoxyoxazole, 4,5-dimethyloxazole, 5-phenyloxazole and 4-methoxyoxazole; the pyridine nucleus includes, for example, 2-pyridine, 4-pyridine, 5-methyl-2-pyridine, and 3-methyl-4-pyridine; and the quinoline nucleus includes, for example, 2-quinoline, 4-quinoline, 3-methyl-2-quinoline, 5-ethyl-2-quinoline, 8-fluoro-2-quinoline, 6-methoxy-2-quinoline, 8-chloro-4-quinoline, and 8-methyl-4-quinoline.

Of those heterocyclic rings for $Z_{51}$ and $Z_{52}$, a benzoxazole nucleus, a benzothiazole nucleus, a naphthoxazole nucleus, a naphthothiazole nucleus, a thiazole nucleus and an oxazole nucleus are preferred. More preferably, the heterocyclic ring is a benzoxazole nucleus, a benzothiazole nucleus or a naphthothiazole nucleus, most preferably a benzoxazole nucleus or a naphthoxazole nucleus.

In formula (V), the heterocyclic ring to be formed by $Z_{51}$ Or $Z_{52}$ may be substituted by at least one substituent. Examples of the substituents include a halogen atom (e.g., fluorine, chlorine, bromine, iodine), a nitro group, an alkyl group (preferably having from 1 to 4 carbon atoms, such as methyl, ethyl, trifluoromethyl, benzyl, phenethyl), an aryl group (e.g., phenyl), an alkoxy group (preferably having from 1 to 4 carbon atoms, such as methoxy, ethoxy, propoxy, butoxy), a carboxyl group, an alkoxycarbonyl group (preferably having from 2 to 5 carbon atoms, such as ethoxycarbonyl), a hydroxyl group, and a cyano group.

In formula (V), the alkyl group represented by $R_{51}$ or $R_{52}$ may be an unsubstituted or substituted alkyl group. The unsubstituted alkyl group preferably has 18 or less carbon atoms, more preferably 8 or less carbon atoms, which includes, for example, a methyl group, ethyl group, n-propyl group, n-butyl group, n-hexyl group, and n-octadecyl group. The substituted alkyl group is preferably one in which the alkyl moiety has 6 or less carbon atoms, especially preferably 4 or less carbon atoms. Examples thereof include a sulfo group-substituted alkyl group (in which the sulfo group may be bonded to the alkyl moiety via an alkoxy group or an aryl group, for example, 2-sulfoethyl, 3-sulfopropyl, 3-sulfobutyl, 4-sulfobutyl, 2-(3-sulfopropoxy)ethyl, 2-[2-(3-sulfopropoxy)ethoxy]ethyl, 2-hydroxy-3-sulfopropyl, p-sulfophenethyl, p-sulfophenylpropyl), a carboxyl group-substituted alkyl group (in which the carboxyl group may be bonded to the alkyl moiety via an alkoxy group or an aryl group, for example, carboxymethyl, 2-carboxyethyl, 3-carboxypropyl, 4-carboxybutyl), a hydroxyalkyl group (for example, 2-hydroxyethyl, 3-hydroxypropyl), an acyloxyalkyl group (for example, 2-acetoxyethyl, 3-acetoxypropyl), an alkoxyalkyl group (for example, 2-methoxyethyl, 3-methoxypropyl), an alkoxycarbonylalkyl group (for example, 2-methoxycarbonylethyl, 3-methoxycarbonylpropyl, 4-ethoxycarbonylbutyl), a vinyl group-substituted alkyl group (for example, allyl), a cyanoalkyl group (for example, 2-cyanoethyl), a carbamoylalkyl group (for example, 2-carbamoylethyl), an aryloxyalkyl group (for example, 2-phenoxyethyl, 3-phenoxypropyl), an aralkyl group (for example, 2-phenethyl, 3-phenylpropyl), or an aryloxyalkyl group (for example, 2-phenoxyethyl, 3-phenoxypropyl).

Especially preferably, at least one group of $R_{51}$ and $R_{52}$ is an alkyl group having a sulfo group or a carboxyl group.

The charge-balancing pair ion X may be any anion which may counterbalance the positive charge to be formed by the quaternary ammonium salt in the hetero ring of the formula. For example, it may be a bromide ion, a chloride ion, an iodide ion, a p-toluenesulfonate ion, an ethylsulfonate ion, a perchlorate ion, a trifluoromethanesulfonate ion, or a thiocyanate ion. In this case, n in formula (V) is 1.

Where the heterocyclic quaternary ammonium salt in the formula further contains an anionic substituent such as a sulfoalkyl substituent, the formula may have a betain form. In this case, the formula needs no pair ion and n is 0.

Where the heterocyclic quaternary ammonium salt has two anionic substituents, for example, two sulfoalkyl groups, $X_n$ is a cationic pair ion, for example, an alkali metal ion (e.g., sodium ion, potassium ion) or an ammonium salt (e.g., triethylammonium ion).

Specific examples of compounds of formula (V) are mentioned below, which, however, are not limitative.

V-1

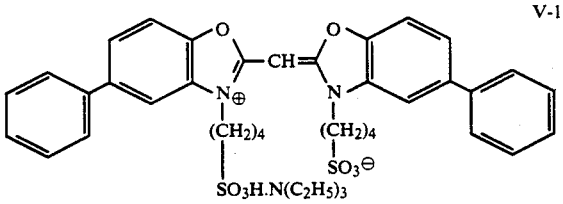

V-2

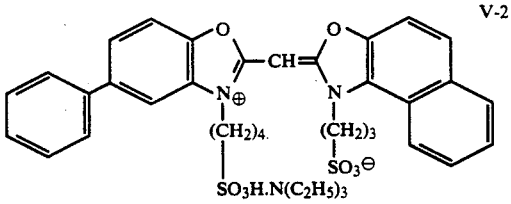

V-3

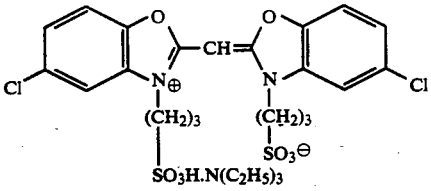

V-4

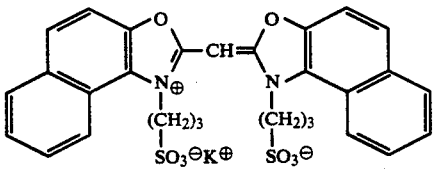

V-5

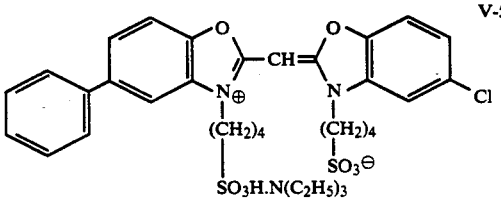

-continued

V-6

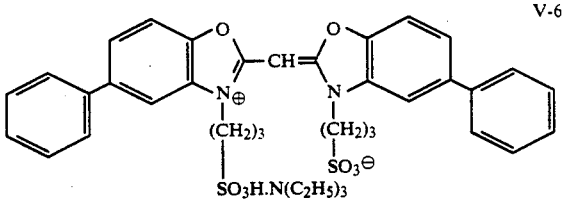

V-7

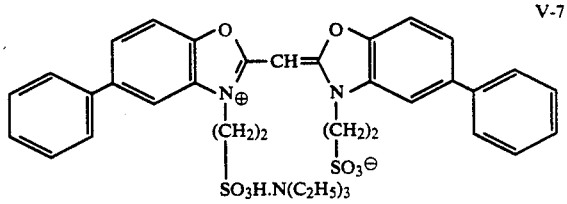

V-8

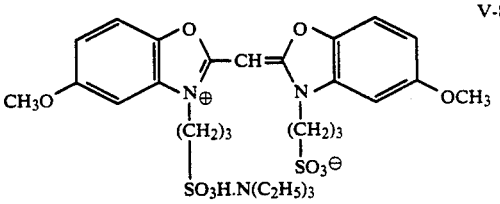

V-9

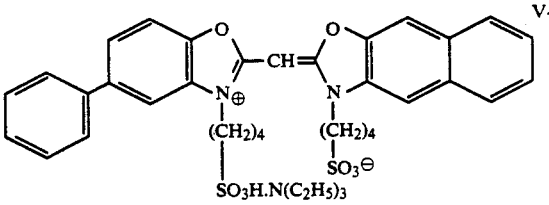

V-10

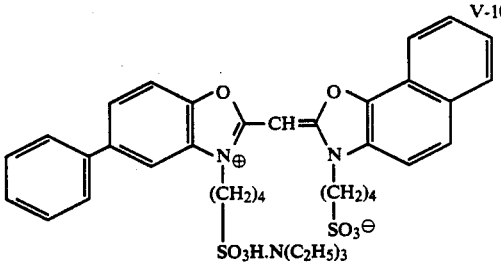

V-11

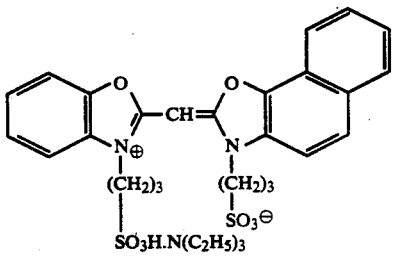

V-12

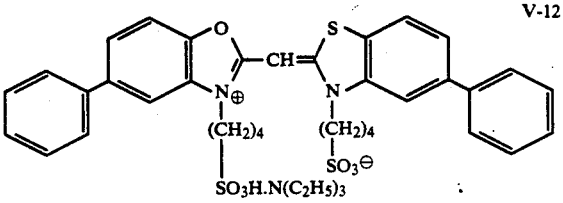

-continued
V-13
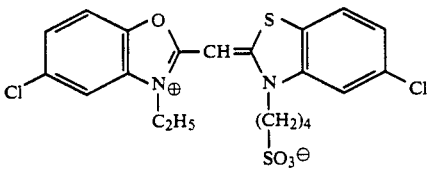
V-14
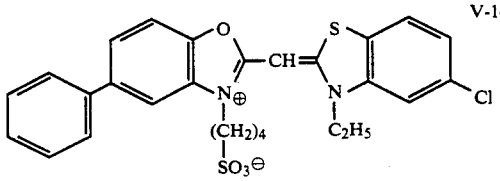
V-15
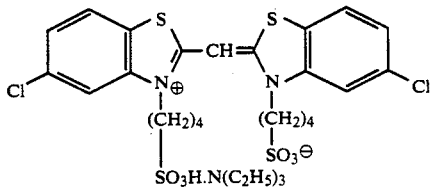
V-16
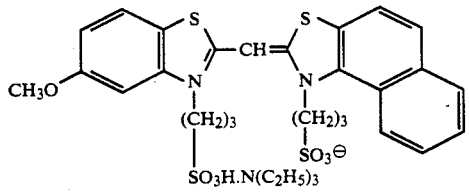
V-17
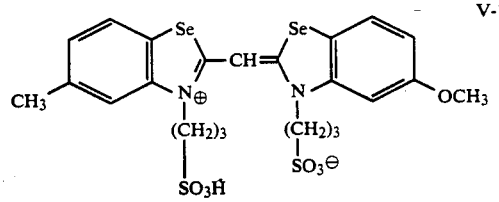
V-18
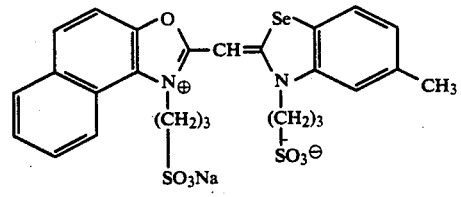
V-19
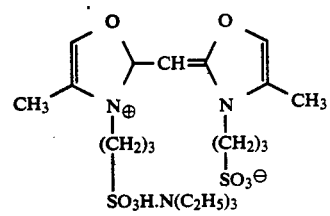
V-20
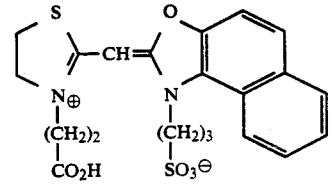
-continued
V-21
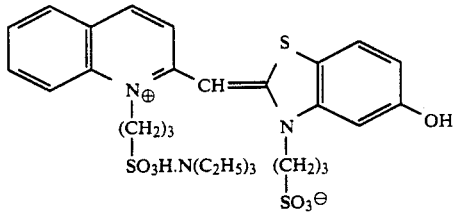
V-22
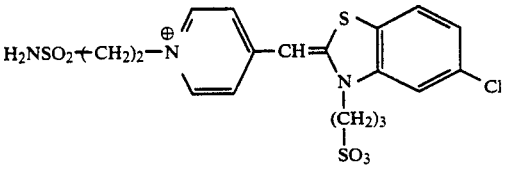
V-23
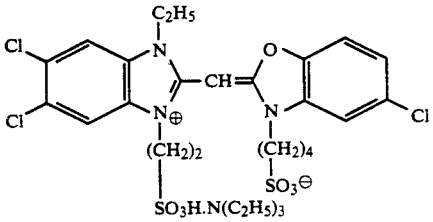
V-24
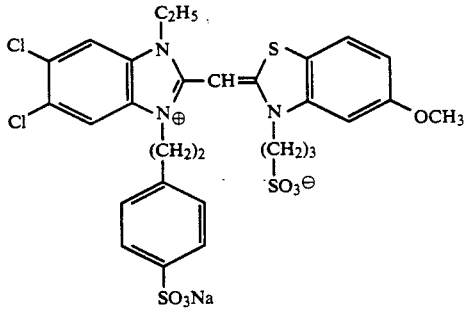
V-25
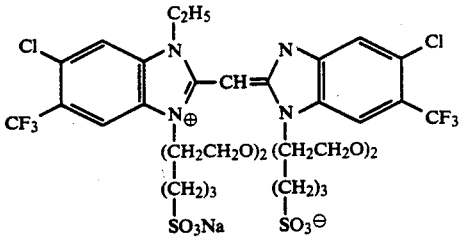
V-26
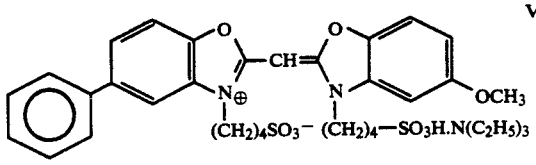
V-27
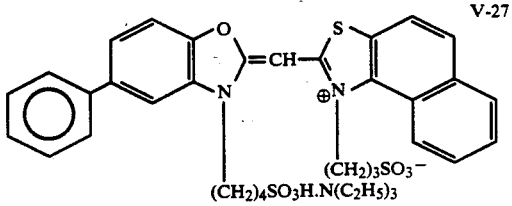
To incorporate the above-mentioned sensitizing dyes into the photographic material of the present invention, the dyes are added to silver halide emulsions in the form of an aqueous solution or a solution formed by dissolving the dyes in water or in a water-miscible organic solvent such as methanol, ethanol, propyl alcohol, methyl cellosolve or pyridine.

These sensitizing dyes may be dissolved ultrasonically, in accordance with the technical means described in U.S. Pat. No. 3,485,634. Other means usable for dissolving or dispersing the sensitizing dyes for use in the present invention are described in, for example, U.S. Pat. Nos. 3,482,981, 3,585,195, 3,469,987, 3,425,835, 3,342,605, British Patents 1,271,329, 1,038,029, 1,121,174, and U.S. Pat. Nos. 3,660,101, 3,658,546.

With respect to the time of addition the sensitizing dyes to the emulsions of the photographic material of the present invention, the dyes are generally added before the emulsions are coated on a proper support. However, they may also be added during the step of chemical ripening of the emulsions or at the step of forming silver halide grains.

The preferred amount of the sensitizing dyes to be added to the photographic material of the present invention is suitably from $1\times10^{-6}$ to $1\times10^{-1}$ mol, preferably from $1\times10^{-4}$ to $1\times10^{-2}$ mol, per mol of silver.

The above-mentioned sensitizing dyes may be incorporated into the photographic material of the present invention singly or in combination of two or more. In particular, the combination of the dyes of formulae (IV) and (V) is effective in preventing the formation of black spots (so-called black peppers) which is experienced in the development system using a hydrazine derivative as a nucleating agent and thus it is preferred.

A combination of sensitizing dyes is often employed for the purpose of super-color sensitization, and such combination use of dyes is also applicable to the present invention. Combinations of useful dyes for displaying the intended super-color sensitization as well as substances which display super-color sensitizability by themselves are described in RESEARCH DISCLOSURE, Vol. 176, Item No. 17643 (December, 1978), page 23, IV-J.

Any silver halide of (e.g., silver chloride, silver chlorobromide, silver iodochloride or silver iodochlorobromide) may be used for forming the photographic material of the present invention. Preferred is a silver halide having a silver chloride content of at least 50 mol %, especially preferably at least 70 mol %. The silver iodide content in the silver halide for use in the invention is preferably 3 mol % or less, more preferably 0.5 mol % or less.

Regarding the mean grain size of the silver halide for use in the invention, the grains are preferably fine grains (for example, having a mean grain size of 0.7 micron or less). More preferably, the grains have a grain size of 0.5 micron or less. Though the grain size distribution of the grains is basically not limitative, the grains are preferably in the form of a monodispersed emulsion. The "monodispersed emulsion" as referred to herein means that at least 95% by number or by weight of the silver halide grains in the emulsion have a grain size falling within the range of the mean grain size plus/minus 40%.

The silver halide grains in the photographic emulsions of the photographic material of the present invention may be regular crystals such as cubic or octahedral crystals, or may be irregular crystals such as spherical or tabular crystals, or composite crystals composed of such various crystal forms.

The silver halide grains may have a uniform phase throughout the whole grain or may have different phases in the inside of the grain and the surface layer. Two or more different silver halide emulsions separately prepared may be blended for use in the present invention.

The silver halide grains to be used in the photographic material of the present invention may be formed or physically ripened in the presence of a cadmium salt, a sulfite, a lead salt, a thallium salt, a rhodium salt or a complex salt thereof, or an iridium salt or a complex salt thereof.

The emulsion layers and other hydrophilic colloid layers of the photographic material of the invention can contain various water-soluble dyes, as a filter dye or for the purpose of anti-irradiation or for other various purposes. Suitable filter dyes include dyes capable of further lowering photographic sensitivity, preferably ultraviolet absorbents having a color absorption maximum in the intrinsic sensitivity range of silver halides or dyes having a substantial light absorption essentially in the range of from 350 nm to 600 nm for the purpose of elevating the safety to safe light where the photographic material is handled as a daylight material.

These water-soluble dyes are added to the emulsion layers of the photographic material, or they are preferably added along with a mordant to and fixed in an upper layer over the silver halide emulsion layers or a non-light-sensitive hydrophilic colloid layer which is remote from the support with respect to the silver halide emulsion layers.

Specific examples of the water-soluble dyes usable in the present invention for the above purpose are described in Japanese Patent Application No. 61-209169, and some preferred examples are mentioned below.

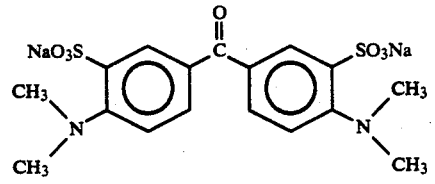

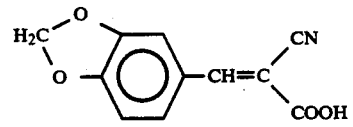

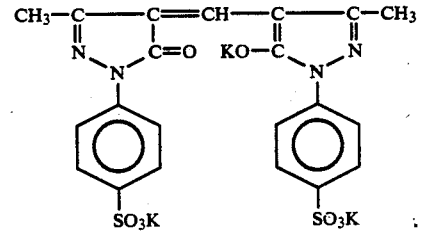

-continued

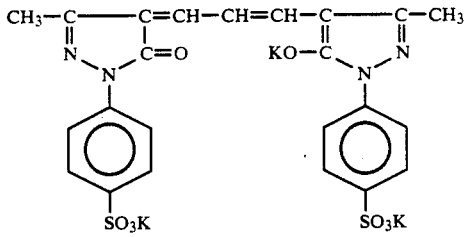

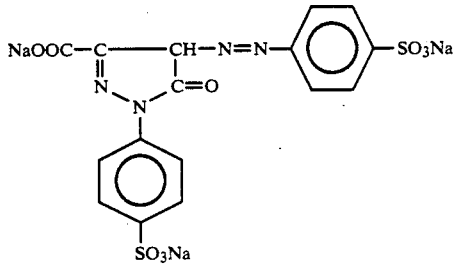

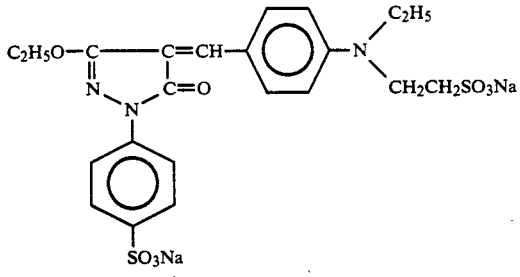

The above-mentioned dyes water-soluble may be dissolved in a suitable solvent (for example, water, alcohols such as methanol, ethanol or propanol, or acetone, methyl cellosolve, or a mixture of two more of the above compounds), and the resulting solution may be added to the non-light-sensitive hydrophilic colloid layer-coating composition before preparing the photographic material of the invention.

Two or more of these water-soluble dyes may be used in combination.

The dyes may be incorporated into the photographic material of the invention in an amount that is sufficient for making the material processable under a daylight condition.

In particular, the amount of the dye may be generally from $1\times10^{-3}$ g/m$^2$ to 1 g/m$^2$, preferably $1\times10^{-2}$ g/m$^2$ to 1 g/m$^2$ and especially preferably from 0.05 g/m$^2$ to 0.5 g/m$^2$, though varying in accordance with the molar extinction coefficient of the dye.

The silver halide emulsion layers constituting the photographic material of the present invention can contain known color sensitizing dyes other than those described above.

The photographic material of the present invention can contain various compounds for the purpose of preventing the materials from fogging during manufacture, storage or photographic processing thereof or for the purpose of stabilizing the photographic properties of the material. For instance, various compounds which are known as an antifoggant or stabilizer can be employed. Examples include azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles, nitrobenzotriazoles; mercaptopyrimidines; mercaptotriazines; thioketo compounds such as oxazolinethione; azaindenes such as triazaindenes, tetrazaindenes (especially, 4-hydroxy-substituted (1,3,3a,7)-tetrazaindenes), pentazaindenes; as well as benzenethiosulfonic acids, benzenesulfinic acids and benzenesulfonic acid amides. Above all, benzotriazoles (for example, 5-methyl-benzotriazole) and nitroindazoles (for example, 5-nitroindazole) are preferred. The compounds may be added to the processing solutions to be used for processing the photographic material.

The photographic material of the present invention can contain an inorganic or organic hardening agent in the photographic emulsion layers or other hydrophilic colloid layers. For instance, one or more hendering agents selected from active vinyl compounds (e.g., 1,3,5-triacryloylhexahydro-s-triazine, 1,3-vinylsulfonyl-2-propanol), active halogen compounds (e.g., 2,4 dichloro-6-hydroxy-s-triazine) and mucohalogenic acids can be used singly or in combination.

The photographic material of the present invention can further contain various surfactants in the photographic emulsion layers or other hydrophilic colloid layers for coating assistance, prevention of static charge, improvement of slide property, emulsification and dispersion, prevention of surface blocking and improvement of photographic characteristics (for example, acceleration of developability, elevation of contrast and enhancement of sensitivity).

Additionally, it may further contain a polymer latex such as a polyalkyl acrylate, for improvement of the dimensional stability of the material.

For processing the photographic material of the present invention, the developer to be used may contain a development accelerator or an accelerator for nucleating infectious development. As the accelerator, effective compounds are described in JP-A-53-77616, 54 37732, 53-137133, 60-140340 and 60-14959, as well as other various compounds containing N and/or S atoms.

Specific examples of such accelertor compounds are mentioned below.

(A-1)

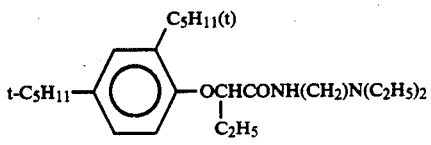

(A-2)

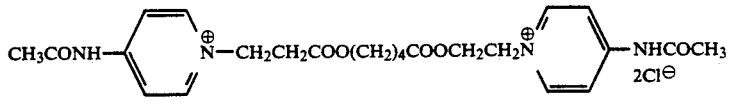

-continued (A-3)

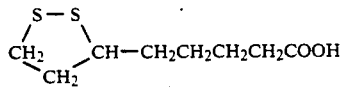

(A-4)

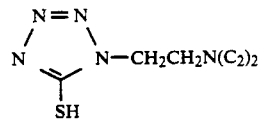

(A-5)

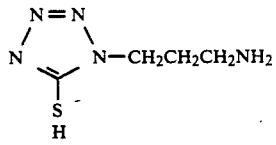

(A-6)

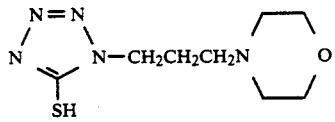

(A-7)

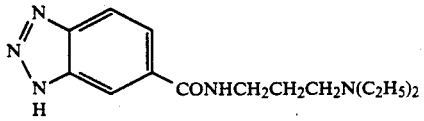

(A-8)

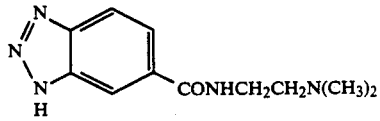

(A-9)

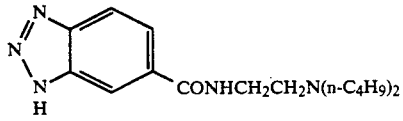

(A-10)

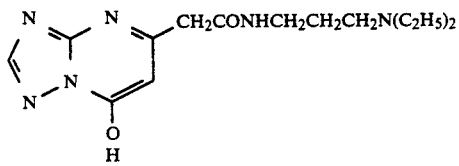

(A-11)

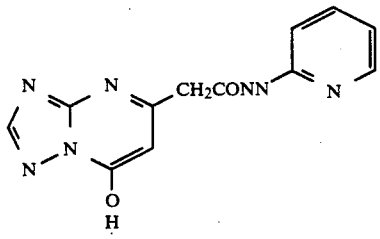

(A-12)

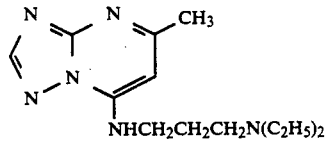

(A-13)

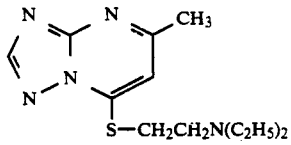

(A-14)

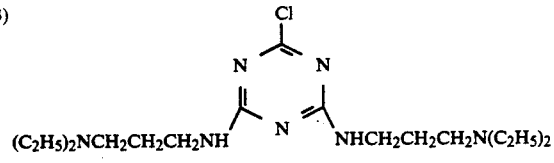

(A-15)

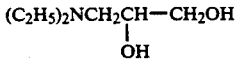

(A-16)

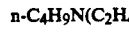

The optimum amount of the accelerator to be added to the photographic material of the present invention, though varying in accordance with the kind of the accelerator, is preferably from $1.0\times10^{-3}$ to 0.5 g/m$^2$, more preferably from $5.0\times10^{-3}$ to 0.1 g/m$^2$.

Ultra-hard photographic images can be obtained by processing the photographic material of the present invention without having to use known infectious developers or high-alkali developers having a pH value of about 13 as described in U.S. Pat. No. 2,419,975. In fact, any other stable developers can be used.

Specifically, the silver halide photographic material of the present invention may effectively be processed with a developer containing a sulfite ion as a preservative in an amount of 0.15 mol/liter or more and having a pH value of from 10.5 to 12.3, especially from 11.0 to 12.0, whereby sufficiently ultra-hard negative images can be obtained.

The developing agent in the developer which is used for processing the photographic material of the present invention is not specifically limited, but any of dihydroxybenzene (e.g., hydroquinone), 3-pyrazolidones (e.g., 1-phenyl-3-pyrazolidone, 4,4-dimethyl-1-phenyl-3-pyrazolidone), and aminophenols (e.g., N-methyl-p-aminophenol) can be used singly or in combination.

The silver halide photographic material of the present invention is preferably developed with a developer containing a dihydroxybenzene compound as a main developing agent and a 3-pyrazolidone or aminophenol compound as an auxiliary developing agent. Desirably, in the developer of this type, the amount of the dihydroxybenzene compound is from 0.05 to 0.5 mol/liter, and the amount of the -pyrazolidone or aminophenol compound is 0.06 mol/liter or less.

Amines may be added to the developer used for processing the photographic material of the present invention for the purpose of accelerating the developing rate and shortening the development time, as disclosed in U.S. Pat. No. 4,269,929 and Japanese Patent Application No. 1-294185.

The developer may further contain a pH buffer such as alkali metal sulfites, carbonates, borates or phosphates, as well as a development inhibitor or anti-foggant such as iodides, bromides or organic anti-foggants (especially preferably, nitroindazcles or benzotriazoles). Additionally, the developer may also contain, if desired, a water softener, a dissolution aid, a toning agent, a development accelerator, a surfactant (especially preferably, polyalkylene oxides), a defoaming agent, a hardening agent, and an inhibitor for silver stains on films (for example, silver 2-mercaptobenzimidazolesulfonate).

As a fixer to be used for processing the developed photographic material of the present invention, any fixer having a conventional composition may be used. As the fixing agent to be in the fixer, thiosulfates, thiocyanates as well as any other organic sulfur compounds which are known to have an activity as a fixing agent can be used. The fixer may contain a water-soluble aluminium salt or the like as a hardening agent.

The processing temperature in processing the photographic material of the present invention may generally be from 18° C. to 50° C.

An automatic developing machine is preferably employed for processing the photographic material of the present invention. The total processing time for processing the material in an automatic developing machine, which is defined as the time from introduction of the material to be processed into the machine to taking out of the finished material from the machine, may be from 90 seconds to 120 seconds, whereupon an excellent image having a sufficiently ultra-hard negative gradation can be formed on the processed material.

The developer to be used for processing the photographic material of the present invention can contain compounds described n JP-A-56-24347 as a silver stain inhibitor. As a dissolution aid which may be added to the developer, compounds described in JP-A-61-267759 can be employed. As a pH buffer which may also be added to the developer, compounds described in JP-A-60-93433 and compounds described in JP-A-62-186259 can be employed.

The following examples are intended to illustrate the present invention in more detail but are not intended to limit the invention in any way.

EXAMPLE 1

Preparation of Light-Sensitive Emulsions

Preparation of Emulsion-A1

An aqueous solution of silver nitrate and an aqueous solution of potassium iodide and potassium bromide were simultaneously added to an aqueous gelatin solution kept at 50° C. in the presence of $4\times10^{-7}$ mol per mol of silver of potassium hexachloroiridate(III), $1.1\times10^{-7}$ mol per mol of silver of ammonium hexachlororhodate(III) and ammonia, over a period of 60 minutes, whereupon the pAg value of the reaction system was kept at 7.8. As a result, a cubic monodispersed emulsion having a mean grain size of 0.28 micron and a mean silver iodide content of 0.3 mol % was prepared. The emulsion was desalted by flocculation, and an inert gelatin was added thereto in an amount of 40 g per mol of silver. Next, the emulsion was kept at 50° C., and $4.2\times10^{-4}$ mol per mol of silver of sensitizing dye Compound (III-1) mentioned above and $1\times10^{-3}$ mol per mol of silver of KI in the form of a KI solution were added thereto. Then, this was allowed to stand as it was for 15 minutes and thereafter cooled. The emulsion thus prepared is Emulsion A1.

Preparation of Emulsion A2

Emulsion A2 was prepared in the same manner as in preparation of Emulsion A1, except that the temperature was varied to 40° C.. Emulsion A2 was a cubic monodispersed emulsion having a mean grain size of 0.23 micron.

Preparation of Emulsion A3

Emulsion A3 was prepared in the same manner as in preparation of Emulsion A1, except that the temperature was varied to 60° C.. Emulsion A3 was a cubic monodispersed emulsion having a mean grain size of 0.33 micron.

Preparation of Emulsion A4

To an aqueous gelatin solution kept at 50° C., were simultaneously added an aqueous silver nitrate solution and an aqueous solution of potassium iodide and potassium bromide in the presence of potassium hexachloroiridate(III) in an amount of $6.7\times10^{-8}$ mol per mol of silver, ammonium hexachlororhodate(III) in an amount of $1.1\times10^{-7}$ mol per mol of silver at the stage just after formation of silver halide grains, and ammonia, over a period of 10 minutes, whereupon the pAg value in the reaction system was kept to be 7.8. Further, $3.3\times10^{-7}$ mol per mol of silver of potassium hexachloroiridate(III) was added thereto, and an aqueous silver nitrate solution and an aqueous solution of potassium bromide and potassium iodide were further added thereto simultaneously at 50° C., whereupon the pAg value of the reaction system was kept to be 7.8. As a result, a cubic monodispersed emulsion having a mean grain size of 0.28 micron and a mean silver iodide content of 0.3 mol % was prepared. The emulsion was desalted by flocculation, and then 40 g per mol of silver of inert gelatin was added thereto. Next, while the emulsion was kept at 50° C., $4.2\times10^{-4}$ mol per mol of silver of a sensitizing dye of Compound (III-1) illustrated above and $1\times10^{-3}$ mol per mol silver of KI in the form of a KI solution were added thereto. Then, this was aged for 15 minutes as it was, and thereafter cooled.

Preparation of Emulsion A5

Emulsion A5 was prepared in the same manner as in preparation of Emulsion A4, except that the amount of ammonium hexachlororhodate(III) was varied to $2.0\times10^{-7}$ mol per mol of silver.

Preparation of Emulsion B

To an aqueous gelatin solution having a temperature of 50° C. and a pH value of 4.0, were added an aqueous silver nitrate solution and a mixed aqueous solution of sodium chloride and potassium bromide containing $2.7\times10^{-7}$ mol per mol of silver of ammonium hexachlororhodate(III) and $4\times10^{-7}$ mol per mol of silver of potassium hexachloroiridate(III) simultaneously at a constant rate over a period of 30 minutes, to prepare a monodispersed silver chlorobromide emulsion (Cl-content: 70 mol %) having a mean grain size of 0.28 micron.

The emulsion was washed with water by a conventional method to remove soluble salts therefrom, and sodium thiosulfate and potassium chloroaurate were added thereto for chemical sensitization. Additionally, a potassium iodide solution, correspondinq to 0.1 mol % per mol of silver, was added thereto for effecting conversion of the surfaces of the silver halide grains in the emulsion. Afterwards, the emulsion was kept at 50° C., and $2.7\times10^{-4}$ mol per mol of silver of sensitizing dye Compound (IV-7) illustrated above, was added thereto. Then, the resulting emulsion was aged for 15 minutes as it was and thereafter cooled and stored.

Preparation of Emulsions B1 to B7

Emulsions B1 to B7 were prepared in the same manner as in preparation of Emulsion B, except that the amount of ammonium hexachlororhodate(III) was varied as indicated in Table 1 below.

TABLE 1

| Emulsion | Amount of Rhodium Added (mol/mol of Ag) |
|---|---|
| B1 | $1.0\times10^{-7}$ |
| B2 | $1.4\times10^{-7}$ |
| B3 | $2.0\times10^{-7}$ |
| B4 | $3.1\times10^{-7}$ |
| B5 | $4.1\times10^{-7}$ |
| B6 | $7.7\times10^{-7}$ |
| B7 | $1.2\times10^{-6}$ |

Preparation of Coated Samples

Plural layers comprising a first light-sensitive Emulsion Layer (EMU), a Middle Layer (ML), a second light-sensitive Emulsion Layer (EMO) and a Protective Coating (PC) were coated in the above order on a polyethylene terephthalate film support (thickness: 150μ) having a vinylidene chloride copolymer subbing layer (thickness: 0.5μ) to prepare Samples Nos. 1 to 12.

Preparation and coating of the plural layers are described below.

Preparation and Coating of EMU

The above-mentioned Emulsion B1 was dissolved in gelatin at 40° C., and 6.5 m9/m$^2$ of 5-methylbenztriazole, 1.3 mg/m$^2$ of 4-hydroxy-1,3,3a,7-tetrazaindene, 1 mg/mz of 1-phenyl-5-mercaptotetrazole, 50 mg/m$^2$ of the following compound (a), polyethyl acrylate in an amount of 15% by weight to gelatin, the following compound (c) in an amount of 15% by weight to gelatin, the following compound (b) as a gelatin-hardening agent in an amount of 4% by weight to gelatin, and $2.5\times10^{-5}$ mol/m$^2$ of Compound I-27 mentioned above as a nucleating agent were added thereto to obtain Emulsion U1.

Compound (a):

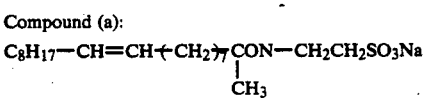

Compound (b):

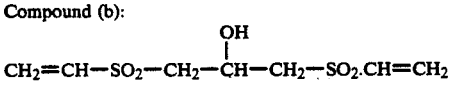

Compound (c):

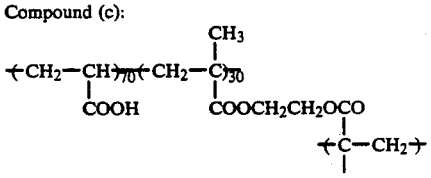

The same procedure as described above was repeated, except for using Emulsion B2 in place of Emulsion B1, whereby Emulsion U2 was obtained.

Each of the resulting composition U1 and U2 was then on the support in an amount of 3.6 g/m$^2$ as silver.

Preparation and Coating of ML

To 10 g gelatin were added polyethyl acrylate in an amount of 20% by weight to gelatin and the above-mentioned compound (a) in an amount of 2% by weight to gelatin. Water was added thereto to make 250 ml in all. The resulting composition was then coated over the previously coated layer EMU in an amount of 1.0 g/m$^2$ as gelatin.

Preparation and Coating of EMO

One of the above-mentioned Emulsions A1 to A5 was dissolved in gelatin, and $6.4\times10^{-5}$ mol/m$^2$ of the redox compound of the invention (Compound II-9 as illustrated above), 1.0 mg /m$^2$ of 4-hydroxy-1,3,3a,7-tetrazaindene, 20 mg/m$^2$ of the above-mentioned compound (a), polyethyl acrylate in an amount of 20% by weight to gelatin, and the above-mentioned compound (b) as a gelatin-hardening agent in an amount of 4% by weight to gelatin were added thereto. Then, the resulting composition was coated over the previously coated layer ML in an amount of 0.4 g/m$^2$ as silver and 0.4 g/m$^2$ as gelatin.

Preparation and Coating of PC

A polymethyl methacrylate dispersion (mean grain size: 5μ) was added to a gelatin solution, and the following surfactants were added thereto. The resulting composition was coated over the previously coated layer in an amount of 0.5 g/m$^2$ as gelatin and 0.5 g/m$^2$ as polymethyl methacrylate.

Surfactants:

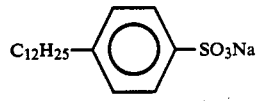

20 mg/m$^2$ $C_8F_{17}SO_2N(C_3H_7)CH_2COOK$ 1.5 mg/m$^2$

Evaluation of Photographic Properties (1) The samples thus prepared were exposed to a tungsten light having a temperature of 3200° K. through an optical wedge or through an optical wedge and a contact screen (150 L Tune Dot Model, manufactured by Fuji Photo Film Co.) and then developed with the following developer for 30 seconds at 34° C. and thereafter fixed, rinsed and dried. As the fixer, GR-F1 (product by Fuji Photo Film Co.) was used.

(2) Apart from the test (1), the samples were exposed in the same manner as in (1) except that a yellow filter (color-correcting filter for color prints, CCY30 Model, manufactured by Fuji Photo Film Co.) was applied to the light source for exposure and thereafter processed in the same manner as in (1).

The developer used above had the following composition.

Developer:

| Chemicals | Amount |
|---|---|
| Hydroquinone | 50.0 g |
| N-Methyl-p-aminophenol | 0.3 g |

-continued

| Developer: Chemicals | Amount |
|---|---|
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)benzenesulfonate | 0.2 g |
| N-n-butyldiethanolamine | 15.0 g |
| Sodium Toluenesulfonate | 8.0 g |
| Water to make | 1 liter |
| Potassium Hydroxide to make | pH of 11.6 |

The results obtained are shown in Table 2 below.

Gradation (gamma, $\gamma$) indicates the inclination of the straight line formed by linking the density point 0.3 and the density point 3.0 on the characteristic curve.

Halftone gradation is represented by the following formula:

$$\text{Halftone Gradation} = \log E95\% - \log E5\%$$

wherein E95% is an exposure amount giving 95% dot area ratio and E5% is an exposure amount giving 5% dot area ratio Halftone quality was visually evaluated by the following five ranks.

5: Best and practically useful as a halftone original for photomechanical process 4: Practically useful 3: Practically useful limit 2: Practically useless 1: Practically useless and worst The difference in sensitivity ($\Delta$log E) between the two light-sensitive layers EMU and EMO is shown in Table 2 below.

The difference in sensitivity ($\Delta$log E) between the first light-sensitive layer (EMU) and the second light-sensitive layer (EMO) was calculated as set forth below.

Samples for calculation of the sensitivity of the first and second light-sensitive layers were prepared by providing the respective EMU or EMO and the PC in sequence on a support in the same manner as described above. The thus prepare samples were exposed to light in the same manner as in the evaluation of photographic properties (1) described above. The exposed samples were developed with an automatic developing machine (FG-660F Model, manufactured by Fuji Photo Film Co., Ltd.) using a developer LD-835 (product of Fuji Photo Film Co., Ltd.) at 38° C. for 20 seconds, and thereafter fixed, rinsed and dried. As the fixer, GR-Fl was used.

The exposure amount of exposure necessary for imparting an optical density of 0.1 of the developed silver of each sample was obtained, and the difference in sensitivity ($\Delta$log E) was obtained on the basis of the following formula.

$$\Delta\log E = \log E_2 - \log E_1$$

Accordingly, where the value of $\Delta$log E is positive, the sensitivity of the first light-sensitive layer is higher than the second light-sensitive layer.

Real density (Dm) is a value of optical density of developed silver resulted by the application of a larger exposure amount than the necessary amount for giving an optical density of developed silver of 1.5 by 0.4 as log E.

The results obtained are shown in Table 2 below.

TABLE 2

| Sample No. | EMU Emulsion | EMO Emulsion | Photographic Properties relS*1 | ΔlogE | γ | Halftone Gradation | Real Density Dm |
|---|---|---|---|---|---|---|---|
| 1 | U1 | A1 | 2.25 | 0.66 | 14.8 | 1.32 | 5.08 |
| 2 | U1 | A2 | 2.26 | 0.75 | 15.3 | 1.31 | 5.13 |
| 3 | U1 | A3 | 2.24 | 0.53 | 14.0 | 1.34 | 5.01 |
| 4 | U1 | A4 | 2.26 | 0.89 | 16.0 | 1.28 | 5.20 |
| 5*3 | U1 | A5 | 2.25 | 1.17 | 17.3 | 1.24 | 5.23 |
| 6 | U2 | A1 | 1.97 | 0.36 | 10.4 | 1.28 | 4.56 |
| 7 | U2 | A2 | 1.98 | 0.45 | 11.5 | 1.33 | 4.87 |
| 8*3 | U2 | A3 | 1.83 | 0.15 | 15.4 | 1.24 | 5.10 |
| 9 | U2 | A4 | 1.98 | 0.59 | 14.6 | 1.31 | 5.05 |
| 10 | U2 | A5 | 1.99 | 0.89 | 16.2 | 1.28 | 5.14 |
| 11*3 | U2 | A4*2 | 2.03 | 0.55 | 17.8 | 1.23 | 5.29 |

*1Relative sensitivity of the first light-sensitive layer, with a higher value implying higher sensitivity.
*2Compound II-9 was not added.
*3Comparative sample As is understood from the results shown in Table 2 above, the comparative sample No. 8 having an extremely small $\Delta$log E was noticeably retarded with respect to the nucleating development of the first light-sensitive layer so that the toe was desensitized, the gradation was hard and the halftone gradation did not broaden. On the other hand, the other comparative sample No. 5 having an extremely large $\Delta$log E (that is, having an extremely lower sensitivity of the second light-sensitive layer than the first light-sensitive layer) displayed a reduced nucleating development-inhibiting effect and gave a narrow halftone gradation.

As opposed to these comparative samples, it is obvious that the samples of the present invention had a hard contrast, had a high gamma value of more than 10, and had a sufficiently high real density Dm and a well broadened halftone gradation.

EXAMPLE 2

Preparation of Coated Samples

Plural layers comprising EMU, ML, EMO and PC were coated in order on a polyethylene terephthalate film support (thickness: 150$\mu$) having a vinylidene chloride copolymer subbing layer (thickness: 0.5$\mu$), to prepare Samples Nos. 1 to 11.

Preparation and coating of the plural layers are mentioned below.

Preparation and Coating of EMU

Emulsion U1 prepared in Example 1 was coated on the support.

Preparation and Coating of ML

ML was coated in the same manner as in Example 1.

Preparation and Coating of EMO

One of the above-mentioned Emulsions B1 to B7 of Example 1 was dissolved in gelatin, and the redox compound of the invention as indicated in Table 3 below, 1.0 mg /m$^2$ of 4-hydroxy 1,3,3a,7-tetrazaindene, 20 mg/m$^2$ of the abovementioned compound (a), polyethyl acrylate in an amount of 20% by weight to gelatin, and the above-mentioned compound (b) as a gelatin-hardening agent in an amount of 4% by weight to gelatin were added thereto. Then, the resulting composition was coated over the previously coated layer ML in an amount of 0.4 g/m$^2$ as silver and 0.4 g/m$^2$ as gelatin.

Preparation and Coating of PC

PC was coated over the previously coated EMO, in the same manner as in Example 1.

The thus prepared samples were exposed and processed exactly in the same manner as in Example 1. The results obtained are shown in Table 3 below. Evaluation of the photographic properties of the thus processed samples was also effected in the same manner as in Example 1.

TABLE 3

| Sample No. | EMO Emulsion | Redox Compound Kind | Redox Compound Amount Added (*) (mol/m$^2$) | Photographic Properties relS*1 | ΔlogE | γ | Halftone Gradation | Density Dm |
|---|---|---|---|---|---|---|---|---|
| 1*2 | B1 | — | — | 2.28 | 0.18 | 18.6 | 1.18 | 5.22 |
| 2*2 | B1 | II-7 | $7.9 \times 10^{-5}$ | 2.09 | 0.16 | 15.0 | 1.22 | 4.96 |
| 3*2 | B1 | II-9 | $6.4 \times 10^{-5}$ | 2.08 | 0.18 | 14.7 | 1.24 | 4.88 |
| 4 | B2 | II-9 | $3.5 \times 10^{-5}$ | 2.25 | 0.44 | 12.2 | 1.30 | 4.82 |
| 5*2 | B3 | — | — | 2.66 | 0.51 | 18.1 | 1.19 | 5.18 |
| 6 | B3 | II-7 | $7.9 \times 10^{-5}$ | 2.25 | 0.54 | 13.1 | 1.30 | 4.88 |
| 7 | B3 | II-9 | $6.4 \times 10^{-5}$ | 2.24 | 0.53 | 12.7 | 1.31 | 4.83 |
| 8 | B3 | II-14 | $3.5 \times 10^{-5}$ | 2.23 | 0.51 | 12.3 | 1.33 | 4.77 |
| 9 | B4 | II-9 | $6.4 \times 10^{-5}$ | 2.26 | 0.58 | 14.6 | 1.31 | 4.83 |
| 10 | B5 | II-9 | $6.4 \times 10^{-5}$ | 2.25 | 0.68 | 15.2 | 1.30 | 4.89 |
| 11*2 | B6 | II-9 | $6.4 \times 10^{-5}$ | 2.24 | 1.03 | 17.2 | 1.27 | 5.05 |
| 12*2 | B7 | II-9 | $6.4 \times 10^{-5}$ | 2.23 | 1.22 | 17.8 | 1.24 | 5.10 |
| 13*2 | B7 | II-14 | $3.5 \times 10^{-5}$ | 2.23 | 1.18 | 17.1 | 1.25 | 5.01 |

*1Relative sensitivity of the first light-sensitive layer
*2Comparative sample

From the results shown in Table 3 above, it is understood that the comparative samples Nos. 2 and 3, having a value Δlog E of less than 0.2, were desensitized at the toe and the halftone gradation did not broaden. On the other hand, the comparative samples Nos. 11, 12 and 13, having a value Δlog E of more than 1 (one), could not have a sufficient inhibiting effect so that the halftone gradation was small. As opposed to them, the samples of the present invention displayed a broad halftone gradation and gave hard images with good original-reproducibility.

Example 3

Preparation of Light-Sensitive Emulsions

Preparation of Emulsions A6 to A10

Emulsions A6 to A10 were prepared in the same manner as in preparation of Emulsion A1 in Example 1, except that sensitizing dyes as indicated in Table 4 below were added in place of the sensitizing dye in Emulsion A1.

TABLE 4

| Emulsion | Sensitizing Dyes | Amount Added (mol/m$^2$) |
|---|---|---|
| A1 | Compound III-1 | $4.2 \times 10^{-4}$ |
| A6 | Compound III-1 | $1.8 \times 10^{-4}$ |
| | Compound V-15 | $1.3 \times 10^{-4}$ |
| A7 | Compound III-1 | $1.8 \times 10^{-4}$ |
| | Compound V-27 | $1.3 \times 10^{-4}$ |
| A8 | Compound III-20 | $2.0 \times 10^{-4}$ |
| A9 | Compound III-20 | $1.0 \times 10^{-4}$ |
| | Compound V-15 | $1.3 \times 10^{-4}$ |
| A10 | Compound III-20 | $1.0 \times 10^{-4}$ |
| | Compound V-27 | $1.3 \times 10^{-4}$ |

Preparation of Emulsions B8 to B10

Emulsions B8 to B10 were prepared in the same manner as in preparation of Emulsion B in Example 1, except that the amount of ammonium hexachlororhodate(III) added was $3.1 \times 10^{-7}$ mol per mol of silver and that the sensitizing dyes as indicated in Table 5 below were added in the amounts indicated in Table 5, instead of that used in Emulsion B.

TABLE 5

| Emulsion | Sensitizing Dyes | Amount Added (mol/m$^2$) |
|---|---|---|
| B8 | Compound III-20 | $2.2 \times 10^{-4}$ |
| B9 | Compound III-12 | $1.0 \times 10^{-4}$ |
| | Compound V-15 | $1.3 \times 10^{-4}$ |
| B10 | Compound III-20 | $1.0 \times 10^{-4}$ |
| | Compound V-27 | $1.3 \times 10^{-4}$ |

Preparation of Coated Samples

Plural layers comprising EMU, ML, EMO and PC were coated in order on a polyethylene terephthalate film support (thickness: 150μ) having a vinylidene chloride copolymer subbing layer (thickness: 0.5μ), to prepare Samples Nos. 1 to 12.

Preparation and coating of the plural layers are mentioned below.

Preparation and Coating of EMU

Emulsion B prepared in Example 1 was dissolved in gelatin and the same additives as those added to the EMU layer in Example 1 were added thereto. The resulting composition was then coated on the support.

Preparation and Coating of ML

ML was coated on the previously coated layer EMU, in the same manner as in Example 1.

Preparation and Coating of EMO

One of the above-mentioned Emulsions A1 and A6 to A10 and B5 to B10 was dissolved in gelatin, and 1.0 mg/m$^2$ of 4-hydroxy-1,3,3a,7-tetrazaindene, the redox compound of the invention (Compound II-9 illustrated above) in an amount as indicated in Table 6 below, 20 mg/m$^2$ of the above-mentioned compound (a), polyethyl acrylate in an amount of 20% by weight to gelatin, and the above-mentioned compound (b), as a gelatin-hardening agent, in an amount of 4% by weight to gelatin were added thereto. Then, the resulting composition was coated over the previously coated layer ML in an amount of 0.4 g/m$^2$ as silver and 0.4 g/m$^2$ as gelatin.

Preparation and Coating of PC

PC was coated over the previously coated EMO, in the same manner as in Example 1.

The color sensitivity of the first light-sensitive layer and that of the second light-sensitive layer of the thus prepared Samples Nos. 1 to 12 are shown in Table 6 below.

The samples were then processed in the same manner as in Example 1. The results obtained are shown in Table 7 below.

TABLE 6

| | Color-Sensitivity of First Light-Sensitive Layer and Second Light-Sensitive Layer | |
|---|---|---|
| No. | 1st light-sensitive layer (EMU) | 2nd light-sensitive layer (EMO) |
| 1 | green-sensitive | green-sensitive |
| 2 | " | green-sensitive |
| 3 | " | green-sensitive + blue-sensitive |
| 4 | " | green-sensitive + blue-sensitive |
| 5 | " | green-sensitive |
| 6 | " | green-sensitive |
| 7 | " | green-sensitive + blue-sensitive |
| 8 | " | green-sensitive + blue-sensitive |
| 9 | " | green-sensitive |
| 10 | " | green-sensitive |
| 11 | " | green-sensitive + blue-sensitive |
| 12 | " | green-sensitive + blue-sensitive |

TABLE 7

| | | Photographic Properties | | | | | | | | | |
|---|---|---|---|---|---|---|---|---|---|---|---|
| | | Without Yellow Filter | | | | | With Yellow Filter | | | | |
| No. | EMO Emulsion*1 | Δlog E | γ | Halftone Gradation | Dot Quality | Real Density (Dm) | Δlog E | γ | Halftone Gradation | Dot Quality | Real Density (Dm) |
| 1*2 | A1 | 0.41 | 22.5 | 1.22 | 3 | 5.11 | 0.42 | 22.0 | 1.22 | 3 | 5.07 |
| 2 | A1 | 0.43 | 11.0 | 1.31 | 3 | 3.79 | 0.40 | 10.8 | 1.32 | 3 | 3.70 |
| 3 | A6 | 0.38 | 10.6 | 1.35 | 3 | 3.80 | 0.58 | 13.6 | 1.26 | 5 | 4.93 |
| 4 | A7 | 0.40 | 11.0 | 1.32 | 3 | 3.86 | 0.61 | 13.9 | 1.25 | 5 | 5.06 |
| 5*2 | A8 | 0.40 | 23.0 | 1.23 | 3 | 5.05 | 0.40 | 22.6 | 1.23 | 3 | 5.10 |
| 6 | A8 | 0.42 | 10.9 | 1.32 | 3 | 3.85 | 0.40 | 10.6 | 1.33 | 3 | 3.80 |
| 7 | A9 | 0.41 | 10.9 | 1.34 | 3 | 3.77 | 0.61 | 13.5 | 1.26 | 5 | 5.03 |
| 8 | A10 | 0.38 | 10.5 | 1.35 | 3 | 3.73 | 0.63 | 14.6 | 1.23 | 5 | 5.11 |
| 9*2 | B8 | 0.41 | 22.8 | 1.21 | 3 | 5.04 | 0.40 | 22.3 | 1.21 | 3 | 5.11 |
| 10 | B8 | 0.43 | 11.3 | 1.30 | 3 | 3.86 | 0.44 | 11.1 | 1.31 | 3 | 3.91 |
| 11 | B9 | 0.40 | 11.8 | 1.27 | 4 | 4.04 | 0.60 | 14.3 | 1.23 | 5 | 4.97 |
| 12 | B10 | 0.39 | 11.6 | 1.28 | 4 | 3.95 | 0.62 | 14.5 | 1.23 | 5 | 5.07 |

*1 $1.3 \times 10^{-4}$ mol/m$^2$ of the redox compound (Compound II-9) was added to the emulsion in each of the samples other than Sample Nos. 1, 5 and 9 which do not contain the redox compound.
*2 Comparative sample From the results shown in Table 7 above, it is understood that the samples Nos. 2, 6 and 10 of the present invention have a broad halftone gradation and are favorable with respect to the copy dots and the reproducibility of blow-up dot images.

Though the comparative samples Nos. 1, 5, and 9 have a high value of Dm, they have a narrow halftone gradation range so that the quality of copy dots and the reproducibility of blow-up dot images are poor. Thus, the comparative samples Nos. 1, 5 and 9 could not satisfy all the necessary requirements.

Unlike the comparative samples, the samples Nos. 3, 4, 7, 8, 11 and 12 of the present invention have a broad halftone gradation and are satisfactory with respect to the copy dots and the reproducibility of blow-up dot images in the absence of a yellow filter. Where a yellow filter is applied to these samples of the present invention, the halftone image quality is further improved and the real density value (Dm) is elevated further. Thus, these samples have favorable characteristics as a halftone-taking photographic material. Accordingly, by selectively applying a filter to the photographic material of the present invention, the material may practically be used both for obtaining images with a broad halftone gradation for blow-up copy dot images and for obtaining halftone images with an elevated halftone quality and an elevated real density Dm. That is to say, by selective operation of suitable filters to be applied to the photographic materials of the present invention, the materials may satisfactorily display the above-mentioned two characteristics.

From the results thus obtained in the present example, it is understood that the photographic materials of the present invention may satisfactorily be applied to various and diverse kinds of originals to obtain the intended various and diverse kinds of photographic images with satisfactory reproducibility.

EXAMPLE 4

Preparation of Light-Sensitive Emulsions

Preparation of Emulsion C

An aqueous silver nitrate solution and an aqueous sodium chloride solution were simultaneously added to and blended with an aqueous gelatin solution kept at 40° C. in the presence of $3\ 0\times10^{-6}$ mol per mol of silver of $(NH_4)_3RhCl_6$. Next, soluble salts were removed from the resulting blend by a well-known method, and gelatin was added to the resulting emulsion. Then, without chemical ripening, a stabilizer of 2-methyl-4-hydroxy-1,3,3a,7-tetrazaindene was added to the emulsion. This was a monodispersed emulsion of cubic crystalline grains having a mean grain size of 0.15 micron.

Preparation of Emulsion D

Emulsion D was prepared in the same manner as in preparation of Emulsion C above, except that the amount of $(NH_4)_3RhCl_6$ was changed to $6.0\times10^{-6}$ mol per mol of silver.

Preparation of Emulsion E

An aqueous silver nitrate solution and an aqueous sodium chloride solution were simultaneously added to and blended with an aqueous gelatin solution kept at 40° C. in the presence of $6.0\times10^{-6}$ mol of $(NH_4)_3RhCl_6$ per mol of silver. Next, soluble salts were removed from the resulting blend by a well-known method, and gelatin was added to the resulting emulsion. Next, the emulsion was heated up to 50° C., and Compound (V-26) illustrated above was added thereto as a sensitizing dye in an amount of $1.2\times10^{-4}$ mol per mol of silver. After it was allowed to stand as it was for 15 minutes, 2-methyl-4-hydroxy-1,3,3a,7-tetrazaindene was added thereto as a stabilizer and it was cooled.

Preparation of Coated Samples

Plural layers of EMU, ML, EMO and PC were coated in order on a polyethylene terephthalate film support (thickness: 150μ) having a vinylidene chloride copolymer subbing layer (thickness: 0.5μ), to prepare samples Nos. 1 to 6.

Preparation and coating of the plural layers are mentioned below.

Preparation and Coating of EMU

To the above-mentioned Emulsion C were added $1.6\times10^{-3}$ mol per mol of silver of a hydrazine compound of the invention (Compound (I-8) illustrated above), 3.6 mg/m² of the following mercaptotetrazole compound (1), 110 mg/m² of the following dye (2) as a filter dye, 16 mg/m² of the following nucleating agent (3), 40 mg/m² of the following compound (4) and polyethyl acrylate latex in an amount of 30% by weight to gelatin as the solid content. Then, 1,3-vinylsulfonyl-2-propanol was added thereto as a hardening agent. The resulting composition was coated on the polyester support in an amount of 3.0 g/m² as silver. The amount of gelatin content in the coated layer was 1.4 g/m².

(1)

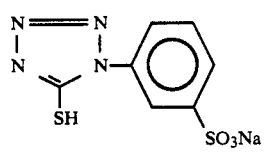

(2)

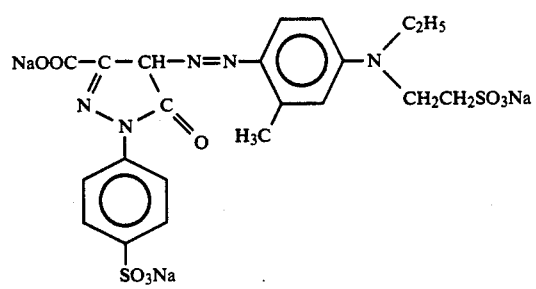

(3)

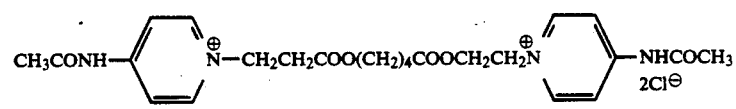

(4)

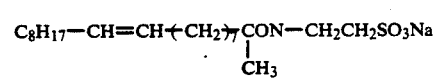

Preparation and Coating of ML

To 10 g gelatin were added polyethyl acrylate in an amount of 20% by weight to gelatin and the above-mentioned compound (4) in an amount of 2% by weight to gelatin. Water was added thereto to make 250 ml in all. The resulting composition was then coated over the previously coated layer EMU in an amount of 1.0 g/m² as gelatin.

Preparation and Coating of EMO

One of the above-mentioned Emulsions D and E was dissolved in gelatin, and 0.6 mg/m² of the mercaptotetrazole compound (1), a redox compound of formula (II) of the present invention (as indicated in Table 8 below) in an amount also indicated in the same Table 8, 15 mg/m² of the above-mentioned compound (4), 2.7 mg/m² of the above-mentioned nucleating agent (3) and polyethyl acrylate latex 1n an amount of 30% by weight to gelatin as the solid content were added thereto. Additionally, a hardening agent of 1,3-vinylsulfonyl-2-propanol was added thereto. The resulting composition was then coated over the previously coated layer ML in an amount of 0.5 g/m$^2$ as silver and 0.5 g/m$^2$ as gelatin.

Preparation of Coating of PC

The following surfactants (5), (6) and (7), the following stabilizer (8) and the following mat agent were added to a gelatin solution, and the resulting composition was coated over the previously coated layer EMO in an amount of 0.5 g/m$^2$ as gelatin.

| | | |
|---|---|---|
| | Surfactants: | |
| (5) | 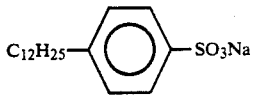 | 12 mg/m$^2$ |
| (6) | $CH_2COOC_5H_{13}$<br>\|<br>$CH_2COOC_5H_{13}$<br>\|<br>$SO_3Na$ | 12 mg/m$^2$ |
| (7) | $C_8F_{17}SO_2N(C_3H_7)CH_2COOK$ | 1.0 mg/m$^2$ |
| | Stabilizer: | |
| (8) | Thioctic Acid | 2.1 mg/m$^2$ |
| | Mat Agent: | |
| | Polymethyl Methacrylate (mean grain size 2.5 micron) | 9.0 mg/m$^2$ |
| | Silica (mean grain size 4.0 micron) | 9.0 mg/m$^2$ |

Evaluation of Photographic Properties (1) The thus prepared samples were imagewise exposed through the original shown in the sole figure of the drawings by the use of a daylight printer P-617DQ (manufactured by Dainippon Screen Mfg. Co., Ltd.) and then developed at 38° C. for 28 seconds, fixed, rinsed in water and dried. The developer and fixer used were same as those used in Example 1.

(2) Apart from the test (1), the samples were exposed in the same manner as in (1) except that an yellow filter (color-correcting filter for color prints, CCY 30 Model, manufactured by Fuji Photo Film Co., Ltd.) was applied to the light source for exposure and thereafter processed in the same manner as in (1).

The thus processed samples were evaluated with respect to the quality of the super-imposed letter image formed thereon as well as the generation, if any, of pin holes on the surface of each sample, by way of a 5-rank evaluation.

For the 5-rank super-imposed letter image evaluation, the photographic material sample was properly exposed through the original of the FIGURE so that 50% of the dot area of the original could be 50% of the dot area of the reproduced image on the sample by contact dot-to-dot work. The rank "5" in the evaluation indicates that letters of 30 microns in width were well reproduced under the condition and the super-imposed letter image quality was excellent. The rank "1" therein indicates that only letters of 150 microns in width or more were reproduced under the same condition and the super-imposed letter image quality was bad. The other ranking of from "4" to "2" between the ranks "5" and "1" was conducted by functional evaluation. The ranks "3" or more indicate the practical level.

With respect to the generation, if any, of pin holes on the processed surface of each sample, the samples were exposed in the same way as in the test for the 5-rank super-imposed letter image evaluation, using the same original of the FIGURE. The frequency of the generation of pin holes on the non-image area of the FIGURE (the area is to be completely blackened after development in the best case) was represented as a relative value of the 5-rank evaluation. The rank "5" indicates that the generation of pin holes is little and the quality of the processed surface is good. The rank "1" indicates that the generation of pin holes is great and the quality of the processed surface is extremely bad. The rank "3" is a critical limit for practical use; and the rank "4" is an intermediate between the ranks "5" and "3". The ranks "2" and "1" are practically useless.

The results obtained are shown in Table 8 below.

TABLE 8

| Sample No. | EMO Emulsion | Redox Compound Kind | Redox Compound Amount Added (mol/m$^2$) | Δlog E | Without Yellow filter: Imposed Letter Image Quality | Without Yellow filter: Pin Holes | With Yellow filter: Imposed Letter Image Quality | With Yellow filter: Pin Holes |
|---|---|---|---|---|---|---|---|---|
| 1*[1] | D | — | — | 0.38 | 3 | 5 | 3 | 5 |
| 2 | D | II-9 | $6.5 \times 10^{-5}$ | 0.39 | 5 | 3 | 5 | 3 |
| 3*[1] | E | — | — | 0.27 | 3 | 5 | 3 | 5 |
| 4 | E | II-9 | $6.5 \times 10^{-5}$ | 0.28 | 5 | 3 | 4 | 5 |
| 5 | E | II-11 | $4.3 \times 10^{-5}$ | 0.28 | 5 | 3 | 3 | 5 |
| 6 | E | II-7 | $9.2 \times 10^{-5}$ | 0.26 | 5 | 4 | 3 | 5 |

*[1]Comparative sample

From the results of Table 8 above, it is understood that the samples Nos. 1 and 3 were good with respect to the prevention of generation of pin holes. However, the super-imposed letter image quality of these samples were insufficient. Even though a yellow filter was applied to these samples, the quality could not be improved. On the other hand, the sample No. 2 had a good super-imposed letter image quality. In particular, the samples Nos. 4 to 6 of the present invention displayed an excellent super-imposed letter image quality in the absence of a yellow filter. After the yellow filter was applied to the samples of the invention, the number of pin holes decreased noticeably.

From the results, the photographic materials of the present invention may be used in the absence of yellow filter where they are desired to display an excellent super-imposed letter image quality. Where the materials of the invention are desired not to have pin holes in the processed surface, a yellow filter is applied to the materials during exposure. Anyway, the necessary photographic properties may effectively be controlled in processing the photographic materials of the present invention.

EXAMPLE 5

Preparation of Light-Sensitive Emulsions

Preparation of Emulsion F1

An aqueous silver nitrate solution and an aqueous sodium chloride solution were simultaneously added to and blended with an aqueous gelatin solution kept at 40° C. in the presence of $3.0\times10^{-6}$ mol per mol of silver of $(NH_4)_3RhCl_6$. Next, soluble salts were removed from the resulting blend by a well-known method, and gelatin was added to the resulting emulsion. Then, without chemical ripening, a stabilizer of -methyl-4-hydroxy-1,3,3a,7-tetrazaindene was added to the emulsion. This was a monodispersed emulsion of cubic crystalline grains having a mean grain size of 0.15 micron.

Preparation of Emulsions F2 to F4

Emulsions F2 to F4 were prepared in the same manner as in preparation of Emulsion F1, except that the amount of $(NH_4)_3RhCl_6$ to be added was varied as indicated in Table 9 below.

TABLE 9

| Emulsion | Amount of Rhodium Added(*) |
|---|---|
| F1 | $3.0\times10^{-6}$ |
| F2 | $2.0\times10^{-6}$ |
| F3 | $6.0\times10^{-6}$ |
| F4 | $9.0\times10^{-6}$ |

(*) (mol/mol of Ag)

Preparation of Emulsion G1

An aqueous silver nitrate solution and an aqueous sodium chloride solution containing $1.0\times10^{-4}$ mol per mol of silver of ammonium hexachlororhodate(III) were blended with a gelatin solution having a temperature of 38° C. by a known double jet method, whereupon the reaction system was controlled to have a pH value of 5.8. Accordingly, a monodispersed silver chloride emulsion having a mean grain size of 0.08 micron was prepared.

After formation of the grains, soluble salts were removed by a well-known flocculation method, and, as stabilizers, 4-hydroxy-6-methyl-1,3,3a,7-tetrazaindene and 1-phenyl-5-mercaptotetrazole were added to the resulting emulsion.

Preparation of Emulsion G2

Emulsion G2 was prepared in the same as in preparation of Emulsion G1, except that the amount of ammonium hexachlororhodate(III) to be added was varied to $7.0\times10^{-3}$ mol per mol of silver.

Preparation of Coated Samples

Plural layers comprising EMU, ML, EMO and PC were coated in order on a polyethylene terephthalate film support (thickness: 150μ) having a vinylidene chloride copolymer subbing layer (thickness: 0.5μ), to prepare the samples Nos. 1 to 6.

Preparation and coating of the plural layers are mentioned below.

Preparation and Coating of EMU

To the above-mentioned Emulsion F1 were added fine polymer grains (prepared as mentioned below) containing $1.6\times10^{-3}$ mol of hydrazine compound (Compound (I-8) illustrated above), per mol of silver, 4.5 mg/m² of the mercaptotetrazole compound (1), 110 mg/m² of the dye (2), 20 mg/m² of the nucleating agent (3) as used in Example 4 and polyethyl acrylate latex in an amount of 30% by weight to gelatin as the solid content. Additionally, a hardening agent of 1,3-vinylsulfonyl- 2-propanol was added thereto. The resulting composition was then coated on the polyester support in an amount of 3.8 g/m² as silver. The amount of gelatin coated was 1.8 g/m².

Preparation of Hydrazine Compound-Containing Fine Polymer Grains

A solution comprising 25 g of hydrazine Compound (I-8), 12.5 g of hydrazine Compound (I-7), 17.5 g of the following melting point-depressing agent (9), 50 g of t-butyl acrylamide polymer and 250 ml of ethyl acetate was heated up to 60° C. to form a complete solution, and thereafter this was added to 1000 ml of an aqueous solution containing 100 g of gelatin, 0.3 g of the following antiseptic (10) and 7.2 g of the above-mentioned surfactant (5). Then, the resulting blend was milled with an auto-homomixer (manufactured by Tokushu Kika Kogyo KK, Japan) to obtain an emulsified dispersion of fine grains. The resulting dispersion was heated under reduced pressure and distilled to remove ethyl acetate therefrom, to thereby obtain the intended hydrazine compound-containing fine polymer grains. The emulsion had a mean grain size of 0.15 micron (as measured with a nanosizer).

Melting Point-Depressing Agent (9):

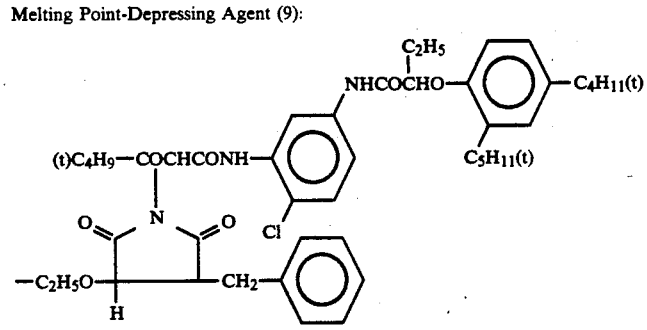

Antiseptic (10):

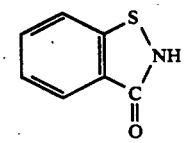

Preparation and Coating of ML 10 g of gelatin, polyethyl acrylate in an amount of 20% by weight to gelatin, and the following compound (11) in an amount of 2% by weight to gelatin were blended, and water was added thereto to finally make 250 ml in all. The resulting composition was coated over the previously coated layer EMU in an amount of 1.0 g/m² as gelatin.

Compound (11):

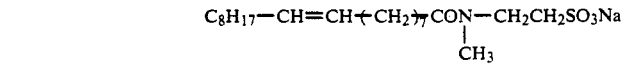

Preparation and Coating of EMO

One of the above-mentioned Emulsions F1 to F4 and Emulsions G1 to G2 was dissolved in gelatin, and 0.6 g/m$^2$ of the above-mentioned mercaptotetrazole derivative (1), $1.0\times10^{-4}$ mol/m$^2$ of the redox compound of the invention (Compound II-9 illustrated above), 15 mg/m$^2$ of the above-mentioned compound (11), 7.2 mg/m$^2$ of the above-mentioned nucleating agent (3) and polyethyl acrylate latex in an amount of 30% by weight to gelatin as the solid content were added thereto. Further, as a hardening agent, 1,3-vinylsulfonyl-2-propanol was added thereto. The resulting composition was coated on the previously coated layer ML in an amount of 0.4 g/m$^2$ as silver and 0.4 g/m$^2$ as gelatin.

Preparation and Coating of PC

The above-mentioned surfactants (5), (6) and (7) and stabilizer (8) as in Example 4 were added to a gelatin solution in amounts of 37 mg/m$^2$, 37 mg/m$^2$, 2.5 mg/m$^2$ and 2.1 mg/m$^2$, respectively, along with the same mixture of the mat agents as in Example 2. The resulting composition was coated over EMO as a protective layer.

Each of the thus prepared samples was imagewise exposed through the original as shown in the FIGURE, by the use of a daylight printer (P-627FM Model, manufactured by Dainippon Screen Mgf. Co., Ltd.), then developed at 38° C. for 20 seconds, fixed, rinsed in water and dried. The processing was effected in an automatic developer (FG-660F Model). The composition of the developer used is mentioned below. As the fixer, GR-F1 (product by Fuji Photo Film Co., Ltd.) was used.

| Developer: Chemicals | Amount |
|---|---|
| Hydroquinone | 50.0 g |
| N-methyl-p-aminophenol | 0.3 g |
| Sodium Hydroxide | 18.0 g |
| 5-Sulfosalicylic Acid | 30.0 g |
| Boric Acid | 20.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonate | 0.2 g |
| Dimethylamino-1-hexanol | 4.0 g |
| Sodium Toluenesulfonate | 15.0 g |
| Water to make | 1 liter |
| Potassium Hydroxide to make | pH of 11.7 |

The thus processed samples were evaluated with respect to the super-imposed letter image quality in the same manner as in Example 4. The results obtained are shown in Table 10 below.

TABLE 10

| Sample No. | EMO Emulsion | ΔlogE | Super-Imposed Letter Image Quality |
|---|---|---|---|
| 1 | F1 | 0.25 | 4 |
| 2*[1] | F2 | 0.13 | 3 |
| 3 | F3 | 0.55 | 5 |
| 4 | F4 | 0.74 | 5 |
| 5*[1] | G1 | 1.48 | 3 |
| 6*[1] | G2 | 1.17 | 3 |

*[1]Comparative sample

From the results of Table 10 above, it is understood that the comparative sample No. 2 did not display a sufficient super-imposed letter image quality as the difference in the sensitivity between the first light-sensitive layer and the second light-sensitive layer was small. With respect to the other comparative samples Nos. 5 and 6, the super-imposed letter image quality was also not improved, since the difference in the sensitivity between the two layers was too large As opposed to them, it is obvious that the samples Nos. 1, 3 and 4 of the present invention gave good images with excellent image quality.

In view of all the results mentioned above, it is understood that the present invention provides good photographic materials capable of giving hard images having a good halftone quality and an excellent super-imposed letter image quality with an excellent original reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide photographic material having on a support a first light-sensitive layer containing a light-sensitive silver halide emulsion and, separate from the first-sensitive layer, a second light-sensitive layer containing a light-sensitive silver halide emulsion, wherein a hydrazine compound is contained in the first light-sensitive layer and/or a hydrophilic colloid layer containing no light-sensitive silver halide emulsion provided on the support, a redox compound which is not the same compound as the hydrazine compound capable of releasing a development inhibitor by oxidation is contained in the second light-sensitive layer, and the sensitivity of the first light-sensitive layer is higher by 0.2 to 1.0 than that of the second light-sensitive layer.

2. The silver halide photographic material as in claim 1, wherein the sensitivity of the first light-sensitive layer is higher by 0.3 to 0.7 than that of the second light-sensitive layer.

3. The silver halide photographic material as in claim 1, wherein the light-sensitive wavelength range of the second light-sensitive layer includes that of the first light-sensitive layer and the former has a broader light-sensitive range than the latter.

4. The silver halide photographic material as in claim 1, wherein the first light-sensitive layer is green-sensitive and the second light-sensitive layer is blue-sensitive and green-sensitive.

5. The silver halide photographic material as in claim 1, wherein the hydrazine compound in the first layer and/or the hydrophilic colloid layer is a compound of formula (I):

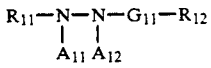

where $R_{11}$ represents an aliphatic group, or an aromatic group; $R_{12}$ represents a hydrogen atom, an alkyl group, an aryl group, an alkoxy group, an aryloxy group, an amino group, or a hydroxyl group; $G_{11}$ represents —CO—, —$SO_2$—, —SO—,

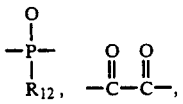

a thiocarbonyl group, or an iminomethylene group; and $A_{11}$ and $A_{12}$ are both hydrogen atoms, or one of them represents a hydrogen atom and the other represents a substituted or unsubstituted alkylsulfonyl group, a substituted or unsubstituted arylsulfonyl group, or a substituted or unsubstituted acyl group.

6. The silver halide photographic material as in claim 1, wherein the redox group in the redox compound is a hydrazine group.

7. The silver halide photographic material as in claim 6, wherein the redox compound is represented by formula (IIa), (IIb) or (IIc):

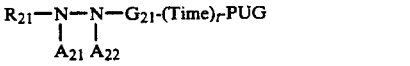

(IIa)

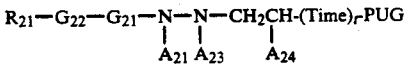

(IIb)

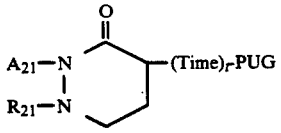

(IIc)

where $R_{21}$ represents an aliphatic group or an aromatic group; $G_{21}$ represents —CO—,

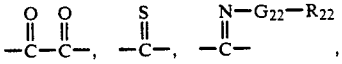

—SO—, —$SO_2$— or

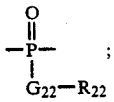

$G_{22}$ represents a chemical bond or represents —O—, —S— or

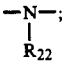

$R_{22}$ represents a hydrogen atom or $R_{21}$; $A_{21}$ and $A_{22}$ independently represent a hydrogen atom, an alkylsulfonyl group, an arylsulfonyl group or an acyl group, which may be substituted; provided that in formula (IIa), at least one of $A_{21}$ and $A_{22}$ must be a hydrogen atom; $A_{23}$ has the same meaning as $A_{21}$ or represents

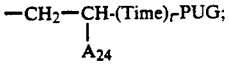

$A_{24}$ represents a nitro group, a cyano group, a carboxyl group, a sulfo group or —$G_{21}$—$G_{22}$—$R_{21}$; Time represents a divalent linking group; t represents 0 or 1; and PUG represents a development inhibitor group.

8. The silver halide photographic material as in claim 1, wherein the amount of redox compound is from $1\times10^{-6}$ to $5\times10^{-2}$ mol, per mole of silver halide in the second light-sensitive layer.

9. The silver halide photographic material as in claim 1, wherein the amount of redox compound is from $1\times10^{-5}$ to $1\times10^{-2}$ mol, per mole of silver halide in the second light-sensitive layer.

10. The silver halide photographic material as in claim 1, wherein the amount of hydrazine compound is from $1\times10^{-6}$ mol to $5\times10^{-2}$ mol, per mol of silver halide in the first light-sensitive layer.

11. The silver halide photographic material as in claim 1, wherein the amount of hydrazine compound is from $1\times10^{-5}$ mol to $2\times10^{-2}$ mol, per mole of silver halide in the first light-sensitive layer.

* * * * *